US010551767B2

(12) United States Patent
Asanuma et al.

(10) Patent No.: US 10,551,767 B2
(45) Date of Patent: Feb. 4, 2020

(54) MANUFACTURING METHOD FOR DEVELOPER CONTAINER, DEVELOPER CONTAINER, DEVELOPING APPARATUS, AND PROCESS CARTRIDGE

(71) Applicant: CANON KABUSHIKI KAISHA, Tokyo (JP)

(72) Inventors: Naoya Asanuma, Susono (JP); Tetsuya Numata, Suntou-gun (JP); Takatoshi Hamada, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 36 days.

(21) Appl. No.: 15/815,421

(22) Filed: Nov. 16, 2017

(65) Prior Publication Data

US 2018/0143564 A1 May 24, 2018

(30) Foreign Application Priority Data

Nov. 22, 2016 (JP) ..... 2016-226554
Oct. 13, 2017 (JP) ..... 2017-199623

(51) Int. Cl.
*G03G 15/08* (2006.01)
*G03G 15/00* (2006.01)

(52) U.S. Cl.
CPC ..... *G03G 15/0856* (2013.01); *G03G 15/752* (2013.01); *G03G 2221/1876* (2013.01)

(58) Field of Classification Search
CPC ..... G03G 21/181; G03G 2215/0872; B29C 2045/14155
See application file for complete search history.

(56) References Cited

U.S. PATENT DOCUMENTS

2015/0016829 A1* 1/2015 Watanabe ..... G03G 15/0856 399/27
2016/0223950 A1* 8/2016 Kato ..... G03G 15/086
2018/0143584 A1* 5/2018 Nosho ..... G03G 21/1652

FOREIGN PATENT DOCUMENTS

JP 2001-117346 A 4/2001
JP 2016-142881 A 8/2016

* cited by examiner

*Primary Examiner* — Gregory H Curran
(74) *Attorney, Agent, or Firm* — Canon U.S.A.Inc., IP Division

(57) ABSTRACT

A developer container is manufactured in which, in molding, a recess is disposed in an area in which a confluence in which first resin poured from a first inlet and second resin poured from a second inlet merge is formed.

6 Claims, 18 Drawing Sheets

MANUFACTURING METHOD FOR DEVELOPER CONTAINER, DEVELOPER CONTAINER, DEVELOPING APPARATUS, AND PROCESS CARTRIDGE

BACKGROUND OF THE INVENTION

Field of the Invention

The present disclosure relates to a developer container, a developing apparatus, a process cartridge, and an image forming apparatus.

Here, "image forming apparatus" refers to an apparatus which forms an image on a recording material. "Process cartridge" refers to a cartridge which at least has an image carrying member. In many cases, the cartridge is an integrated cartridge including a charging unit, a developing unit, a cleaning unit, and an image carrying member, and is detachably attached to an apparatus main body of the image forming apparatus. "Developing apparatus" refers to an apparatus which at least has a developer carrying member. In many cases, "developing apparatus" refers to an integrated apparatus in which a developer carrying member and a developing frame which supports the developer carrying member are integrated with each other, and is detachably attached to an apparatus main body of the image forming apparatus. "Developer container" refers to a container which contains developer.

An electrophotographic image forming apparatus may be a copier, an LED printer, a laser printer, a facsimile machine, and so forth.

Description of the Related Art

In an electrophotographic image forming apparatus (hereinafter, "image forming apparatus"), a usually drum-shaped electrophotographic photoconductor serving as an image carrying member, i.e., a photoconductive drum, is uniformly charged.

Next, by selectively exposing the charged photoconductive drum, an electrostatic latent image (an electrostatic image) is formed on the photoconductive drum. Then, the electrostatic latent image formed on the photoconductive drum is developed as a toner image with toner serving as developer.

Then, the toner image formed on the photoconductive drum is transferred to a recording material, such as a recording sheet or a plastic sheet, and the toner image is fixed to the recording material by applying heat and pressure to the toner image transferred to the recording material, whereby an image is recorded.

Generally, toner needs to be replenished and various process units need to be maintained in this type of image forming apparatus. In order to make maintenance and the replenishment of toner easy, the photoconductive drum, the charging unit, the developing unit, the cleaning unit, etc. are integrated in a frame as a process cartridge which is detachably attached to an apparatus main body of the image forming apparatus. A process cartridge such as that described is in practical use.

With this process cartridge system, since maintenance of the apparatus can be performed by a user, operability can be improved significantly. Therefore, an image forming apparatus with significantly high usability can be provided. Therefore, this process cartridge system is widely used in image forming apparatuses.

In the image forming apparatus employing the process cartridge system described above, a user replaces the process cartridge themselves. Therefore, the image forming apparatus often includes a unit to detect the consumption of toner and inform the user when it is time to replace the process cartridge (i.e., a residual toner detection unit). In an exemplary residual toner detection unit, a toner amount is detected using a change in electrostatic capacitance which changes when the amount of space occupied by toner between a pair of input output electrodes changes (Japanese Patent Laid-Open No. 2001-117346).

Japanese Patent Laid-Open No. 2001-117346 proposes a plate antenna system which includes a pair of input output electrodes, and detects a toner amount by measuring electrostatic capacitance between the two electrodes. Japanese Patent Laid-Open No. 2016-142881 proposes a structure in which styrene resin in which carbon black is dispersed is used as electrodes serving as antennas.

When manufacturing a developer container as proposed in Japanese Patent Laid-Open No. 2016-142881, there is a risk of the issues illustrated in FIGS. 19A to 19C and 20 arising. FIGS. 19A to 19C and 20 are explanatory views illustrating a flow of resin inside of a mold.

Resin J poured from gates 92*r* and 92*l* spreads concentrically (see FIG. 19A).

As the resin is further poured and molding is further performed, the flows of resin poured in from the gates 92*r* and 92*l* merge with each other (a confluence G) (see FIG. 19B).

This can cause a linear mark (a weld line) W to be produced from the confluence G (see FIG. 19C).

If a conductive resin sheet which contains resin is used for the electrodes serving as the antennas, deformation and a projection occur in the resin sheet depending on the type of the poured resin. If the resin is poured in the state in which the resin sheet is placed at the position of the confluence G of FIG. 19B in the mold, deformation and a projection occur in the resin sheet. When the poured resin comes to have the state illustrated in FIG. 19C, deformation and a projection become greater together with the growth of the weld line W.

As a result, when the developer container is manufactured, a projection N projecting from an end portion 30*b* located downstream in a moving direction of the resin is formed in the resin sheet on the frame of the developer container, as illustrated in FIG. 20. If the projection N comes excessively close to a second electrode, the function of detecting the developer amount may be impaired.

SUMMARY OF THE INVENTION

An embodiment of the present disclosure is a manufacturing method for a developer container capable of detecting a developer amount using a change in electrostatic capacitance between a first electrode and a second electrode, including: holding a first resin sheet which will become the first electrode and a second resin sheet which will become the second electrode having a recess in a mold in a manner such that the recess is located to face an end portion of the first resin sheet, and molding the developer container which includes the first resin sheet and the second resin sheet by pouring resin from a first inlet and a second inlet through which resin is poured, wherein in the molding, the recess is disposed in an area in which a confluence in which first resin poured from the first inlet and second resin poured from the second inlet merge is formed.

The present disclosure provides a developer container, a developing apparatus, a process cartridge, and an image forming apparatus.

Further features of the present invention will become apparent from the following description of exemplary embodiments with reference to the attached drawings.

DESCRIPTION OF THE EMBODIMENTS

Hereinafter, embodiments for implementing the present disclosure will be described in detail with reference to the drawings. It is to be noted that dimensions, materials, shapes, relative arrangements, and so forth of the components described in the embodiments described below are changeable depending on the structure of the apparatus or various conditions to which the present disclosure is applied. Those dimensions, materials, shapes, relative arrangements, and so forth do not limit the scope of the present disclosure to the following embodiments.

First Embodiment (this sentence is in the above paragraph) In this specification, a direction in which the rotational axes of the electrophotographic photoconductive drum, the developing roller, and the developing sleeve extend is defined as the longitudinal direction.

In the longitudinal direction of the electrophotographic photoconductive drum, which is the image carrying member, the side on which the electrophotographic photoconductive drum receives driving force from the apparatus main body of an image forming apparatus is defined as a driving side, and the opposite side is defined as a non-driving side.

The entire structure and an image formation process will be described with reference to FIGS. 2 and 3.

Figure 2:
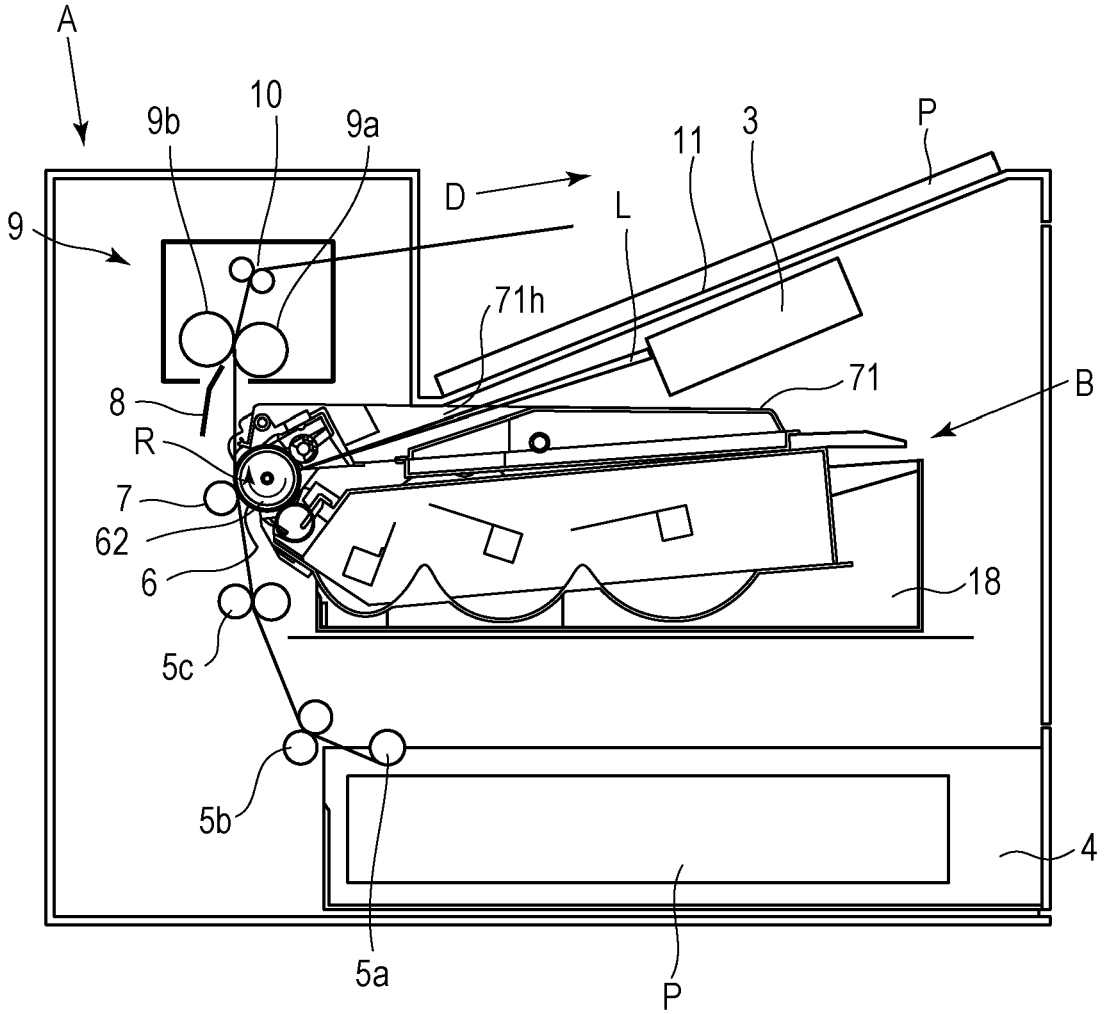
FIG. 2 is a cross-sectional view of an apparatus main body of an electrophotographic image forming apparatus, and a process cartridge.

FIG. 2 is a cross-sectional view of an apparatus main body (hereinafter, "apparatus main body A") of the electrophotographic image forming apparatus (hereinafter, "image forming apparatus"), and the process cartridge (hereinafter, "cartridge B").

Figure 3:
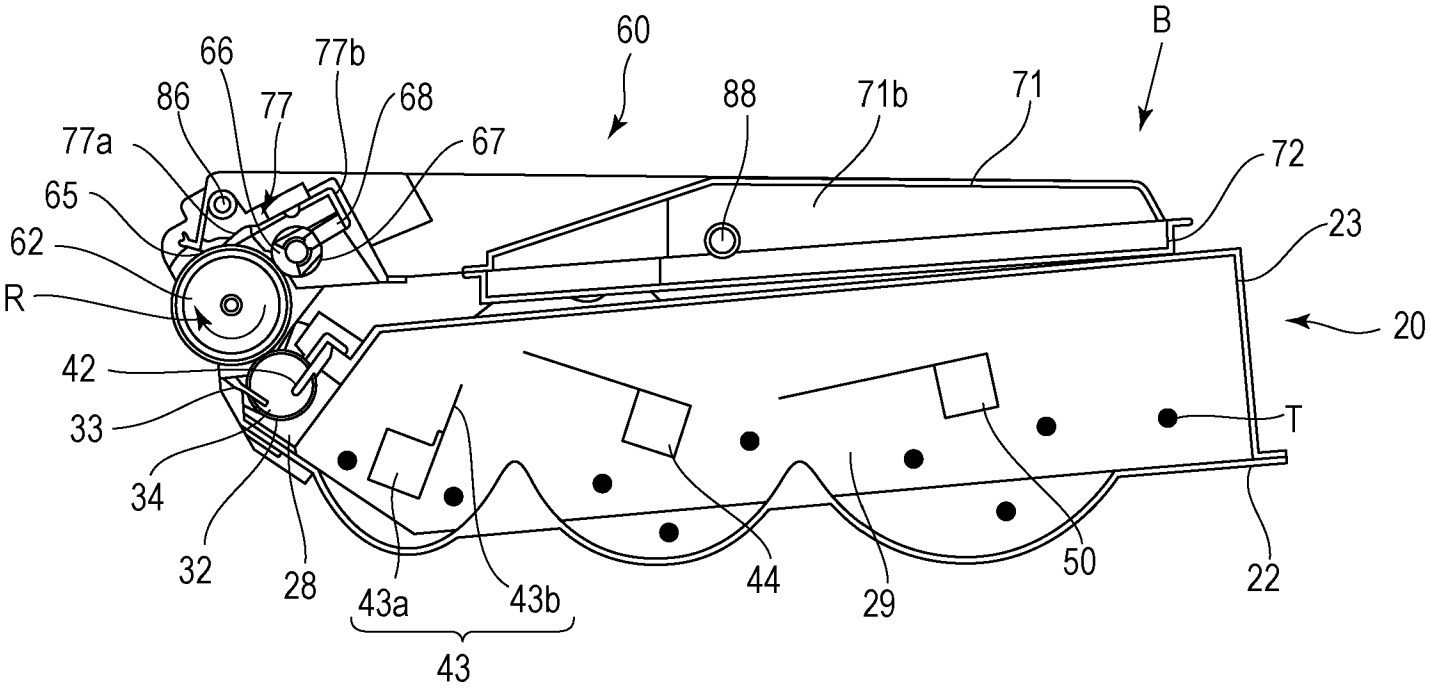
FIG. 3 is a cross-sectional view of the process cartridge according to the first embodiment.

FIG. 3 is a cross-sectional view of the cartridge B. Here, the apparatus main body A is a portion of the electrophotographic image forming apparatus excluding the cartridge B. If a developing apparatus is detachably attached to the apparatus main body independently, the structure of the image forming apparatus from which the developing apparatus is excluded is defined as the apparatus main body.

Entire Structure of Image Forming Apparatus

The image forming apparatus illustrated in FIG. 2 is an electrophotographic laser beam printer in which the cartridge B is detachably attached to the apparatus main body A. When the cartridge B is attached to the apparatus main body A, an exposure apparatus 3 (a laser scanner unit) for forming a latent image on an electrophotographic photoconductive drum 62 of the cartridge B is disposed. Further, a sheet tray 4 containing recording materials (hereinafter, "sheet material P") on which images are to be formed is disposed below the cartridge B.

In the apparatus main body A, a pickup roller 5*a*, a feeding roller pair 5*b*, a conveyance roller pair 5*c*, a transfer guide 6, a transfer roller 7, a conveyance guide 8, a fixing device 9, a discharge roller pair 10, a discharge tray 11, and so forth are sequentially disposed along a conveyance direction D of the sheet material P. The fixing device 9 is constituted by a heating roller 9*a* and a pressure roller 9*b*.

Image Formation Process

Next, an image formation process will be described schematically. In accordance with a print start signal, the electrophotographic photoconductive drum (hereinafter, "drum 62") is driven to rotate at a predetermined circumferential speed (a process speed) in the direction of arrow R.

A charging roller 66 which is a charging member to which a bias voltage is applied is in contact with an outer peripheral surface of the drum 62 to uniformly charge the outer peripheral surface of the drum 62.

The exposure apparatus 3 outputs laser light L in accordance with image information. The laser light L passes through a laser opening 71*h* provided in a cleaning frame 71 of the cartridge B, and scan-exposes the outer peripheral surface of the drum 62. Therefore, an electrostatic image and an electrostatic latent image corresponding to the image information are formed on the outer peripheral surface of the drum 62.

As illustrated in FIG. 3, in a developing unit 20 serving as the developing apparatus, toner T in a developer container (a toner chamber) 29 is stirred and conveyed by rotation of a first conveyance member 43, a second conveyance member 44, and a third conveyance member 50, and is sent out to a toner supply chamber 28. The first conveyance member 43 at least includes a rotatable shaft 43*a* and a sheet-shaped conveying portion 43*b*.

The toner T serving as the developer is carried on a surface of a developing roller 32 which is the developer carrying member and is the developing sleeve by magnetic force of a magnet roller 34 (a stationary magnet).

The toner T is triboelectrically charged on a circumferential surface of the developing roller 32 and a layer thickness of the toner T is regulated by a developing blade 42 which is a developer layer regulating member.

The toner T is developed on the drum 62 in accordance with the electrostatic latent image, and is visualized as a toner image which is a developer image.

As illustrated in FIG. 2, at the timing of outputting the laser light L, the sheet material P contained in the lower portion of the apparatus main body A is fed from the sheet tray 4 by the pickup roller 5*a*, the feeding roller pair 5*b*, and the conveyance roller pair 5*c*. The sheet material P is conveyed to a transfer position between the drum 62 and the transfer roller 7 via a transfer guide 6. At the transfer position, the toner image is sequentially transferred to the sheet material P from the drum 62.

The sheet material P to which the toner image has been transferred is separated from the drum 62 and conveyed to the fixing device 9 along the conveyance guide 8. The sheet material P passes through a nip portion formed by the heating roller 9*a* and the pressure roller 9*b* which constitute the fixing device 9. The toner image is fixed to the sheet material P through fixing processing with pressure and heat in the nip portion. The sheet material P to which the toner image is fixed is conveyed to the discharge roller pair 10 and is discharged to the discharge tray 11.

As illustrated in FIG. 3, residual toner on the outer peripheral surface of the drum 62 after the transfer process is removed by a cleaning blade 77 which is a cleaning member, and the removed toner is used again in the image formation process. The toner removed from the drum 62 is stored in a waste toner chamber 71*b* of a cleaning unit 60.

In the present embodiment, the charging roller 66 which is the charging member, the developing roller 32 which is the developer carrying member, the transfer roller 7 which is the transfer member, and the cleaning blade 77 which is the cleaning member are processing units which act on the drum 62 which is the image carrying member.

Attachment and Removal of Cartridge

Next, attachment and removal of the cartridge B to and from the apparatus main body A will be described with reference to FIGS. 5 and 6.

Figure 5:
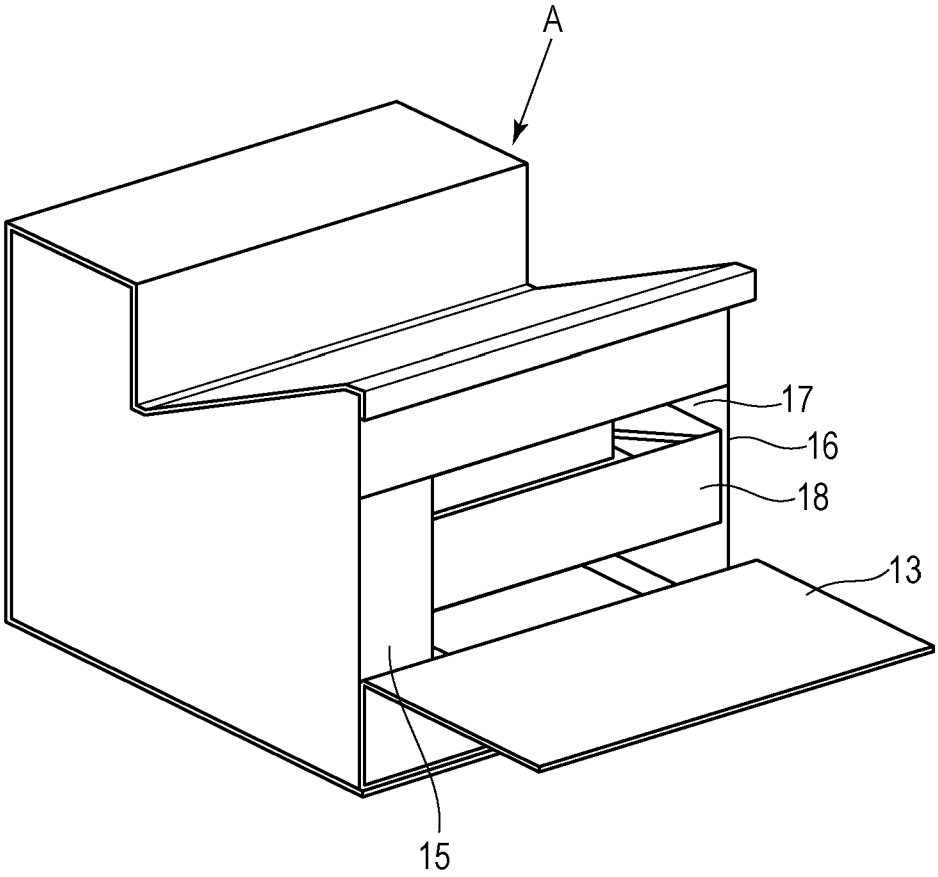
FIG. 5 is a perspective view of the apparatus main body of the electrophotographic image forming apparatus with a door opened.
Figure 6:
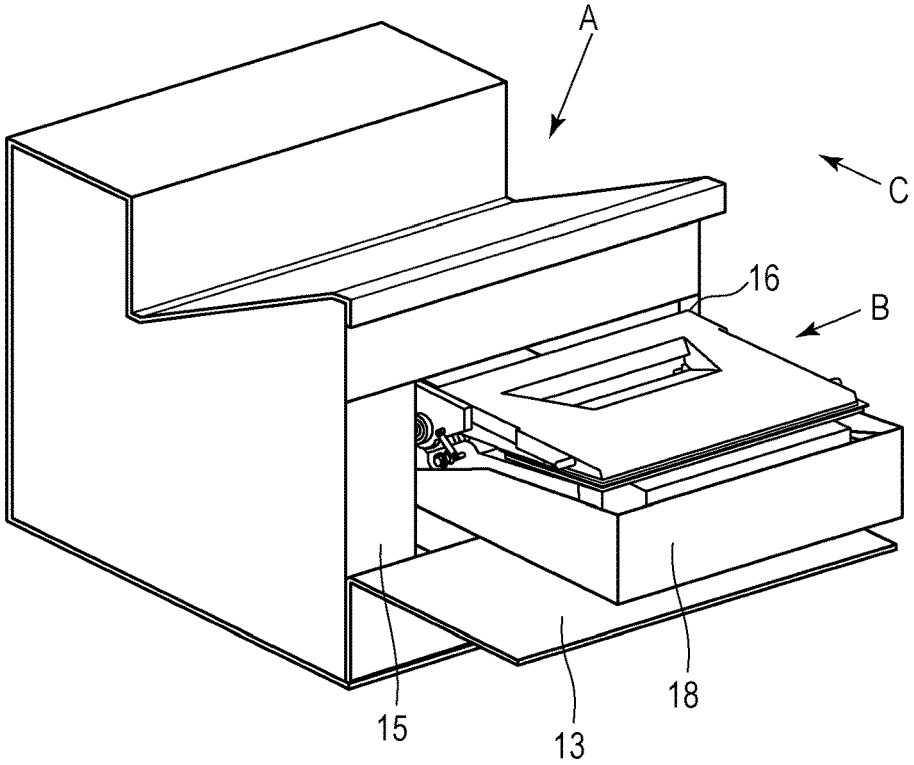
FIG. 6 is a perspective view of the apparatus main body of the electrophotographic image forming apparatus with the door opened and a tray drawn out.
Figure 7:
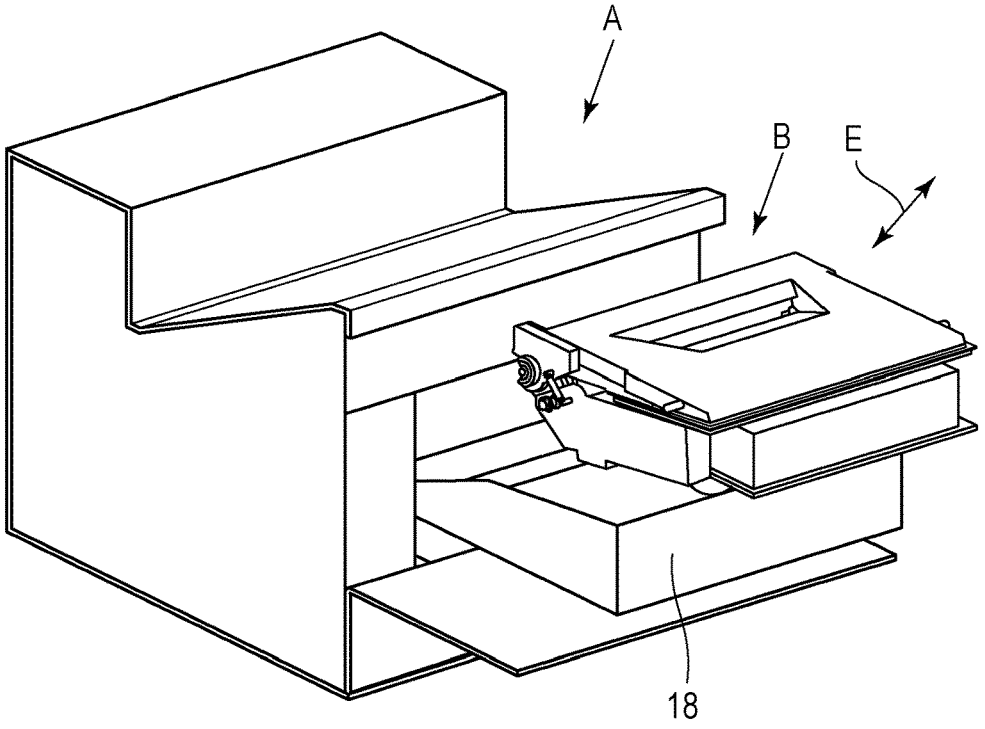
FIG. 7 is a perspective view of the apparatus main body and the process cartridge with the door of the electrophotographic image forming apparatus opened and the tray drawn out, and the process cartridge being attached to or removed from the tray.

FIG. 5 is a perspective view of the apparatus main body A with a door 13 opened for allowing attachment and removal of the cartridge B. FIG. 6 is a perspective view of the apparatus main body A and the cartridge B with the door 13 opened and a tray 18 which is a drawer member and is a moving member drawn out to allow attachment and removal of the cartridge B. FIG. 7 is a perspective view of the apparatus main body A and the cartridge B with the door 13 opened and the tray 18 which is the drawer member drawn out, illustrating a state in which the cartridge B is being attached or removed. The cartridge B can be attached to and removed from the tray 18 in an attachment and removal direction E.

The door 13 is pivotally attached to the apparatus main body A. When the door 13 is opened, a cartridge insertion opening 17 appears. In the cartridge insertion opening 17, the tray 18 for attaching the cartridge B to the apparatus main body A is provided. When the tray 18 is drawn out to a predetermined position, the cartridge B can be attached and removed. The cartridge B, placed on the tray 18, is attached to the inside of the apparatus main body A along a guide rail (not illustrated) in the direction of arrow C.

A first drive shaft 14 and a second drive shaft 19 for respectively transmitting driving force to a first coupling 70 and a second coupling 21 (see FIG. 8) provided in the cartridge B are provided. The first drive shaft 14 and the second drive shaft 19 are driven by a motor (not illustrated) of the apparatus main body A. Therefore, the drum 62 connected to the first coupling 70 is rotated by the driving force of the apparatus main body A. Furthermore, the developing roller 32 is rotated by the driving force of the second coupling 21. Electric power is supplied to the charging roller 66 and the developing roller 32 from a power-feeding unit (not illustrated) of the apparatus main body A.

Cartridge Support

Figure 8:
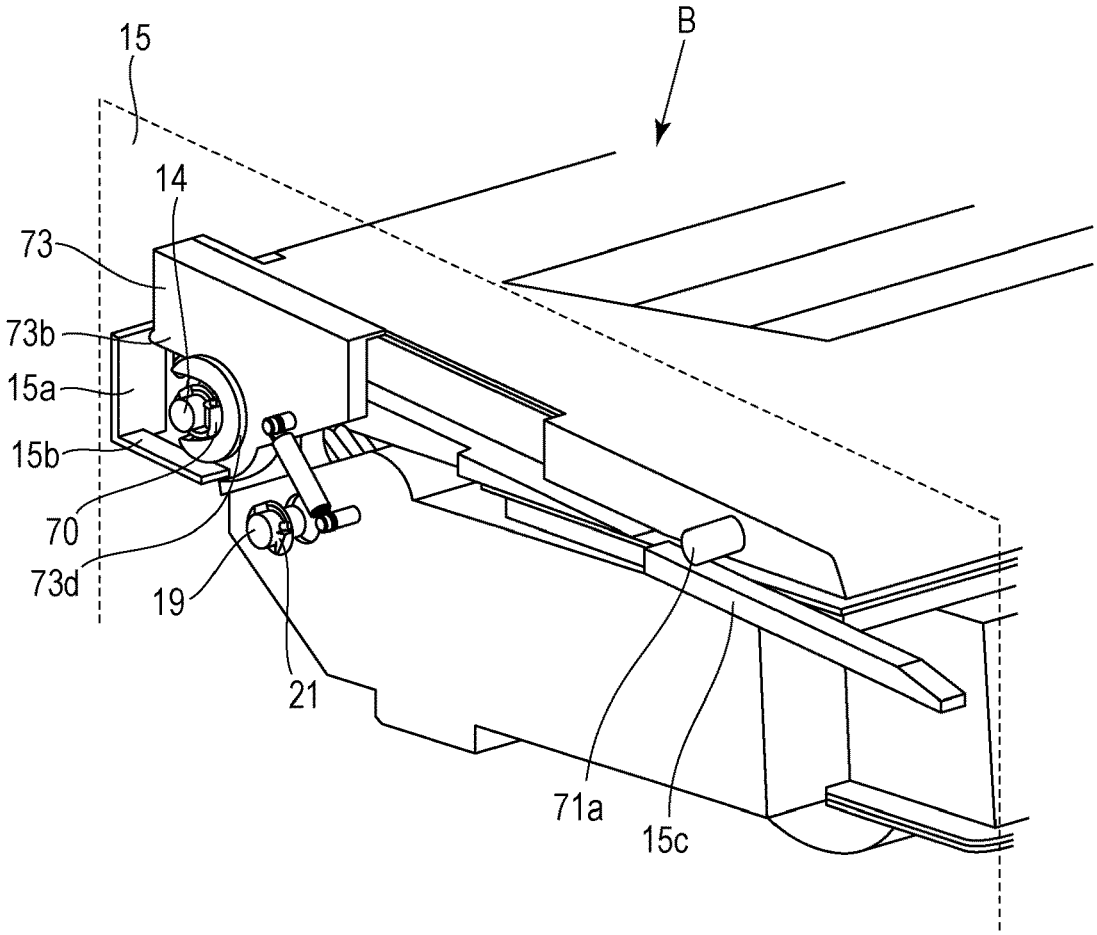
FIG. 8 is a perspective view of a driving side positioning portion of the process cartridge and the apparatus main body with the process cartridge attached to the apparatus main body.
Figure 9:
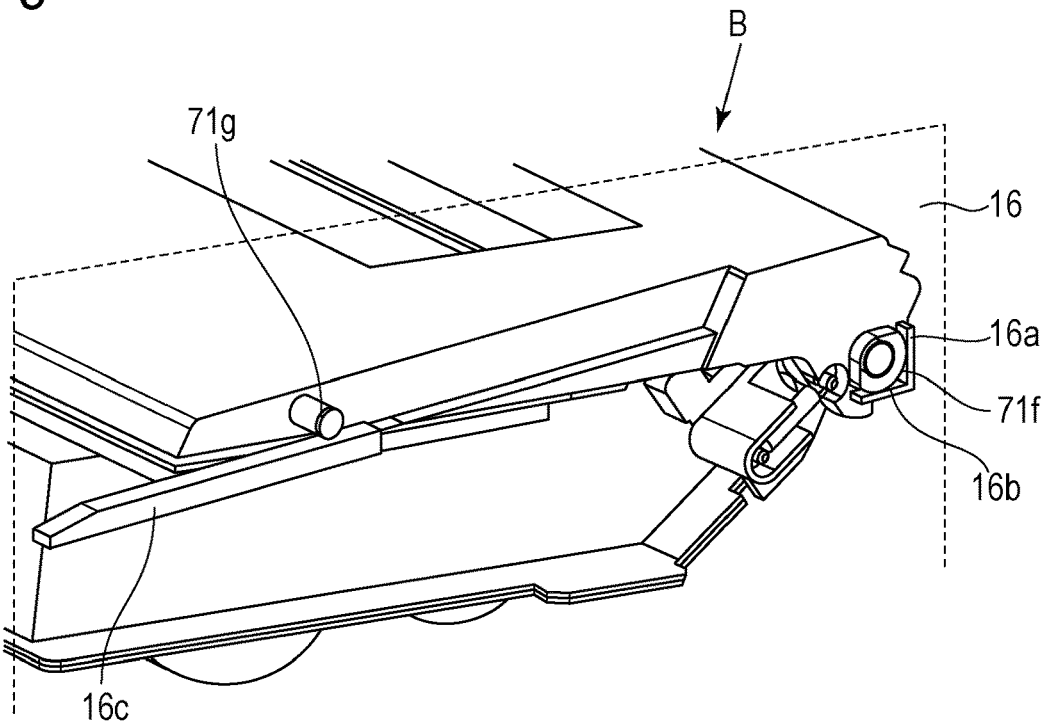
FIG. 9 is a perspective view of a non-driving side positioning portion of the process cartridge and the apparatus main body of the image forming apparatus with the process cartridge attached to the apparatus main body.

As illustrated in FIG. 5, a driving side plate 15 and a non-driving side plate 16 for supporting the cartridge B are provided in the apparatus main body A. As illustrated in FIGS. 8 and 9, the driving side plate 15 has a driving-side first support portion 15*a*, a driving-side second support portion 15*b*, and a rotary support portion 15*c* of the cartridge B. The non-driving side plate 16 has a non-driving side first support portion 16*a*, a non-driving side second support portion 16*b*, and a rotary support portion 16*c*.

As supported portions of the cartridge B, a supported portion 73*b* and a supported portion 73*d* of a drum bearing 73, a driving side boss 71*a*, a non-driving side projection 71*f* and a non-driving side boss 71*g* of the cleaning frame 71 are provided. The supported portion 73*b* is supported by the driving side first support portion 15*a*, the supported portion 73*d* is supported by the driving side second support portion 15*b*, and the driving side boss 71*a* is supported by the rotary support portion 15*c*. The non-driving side projection 71*f* is supported by the non-driving side first support portion 16*a* and the non-driving side second support portion 16*b*, and the non-driving side boss 71*g* is supported by the rotary support portion 16*c*. Therefore, the cartridge B is positioned within the apparatus main body A.

Entire Structure of Cartridge

Figure 10:
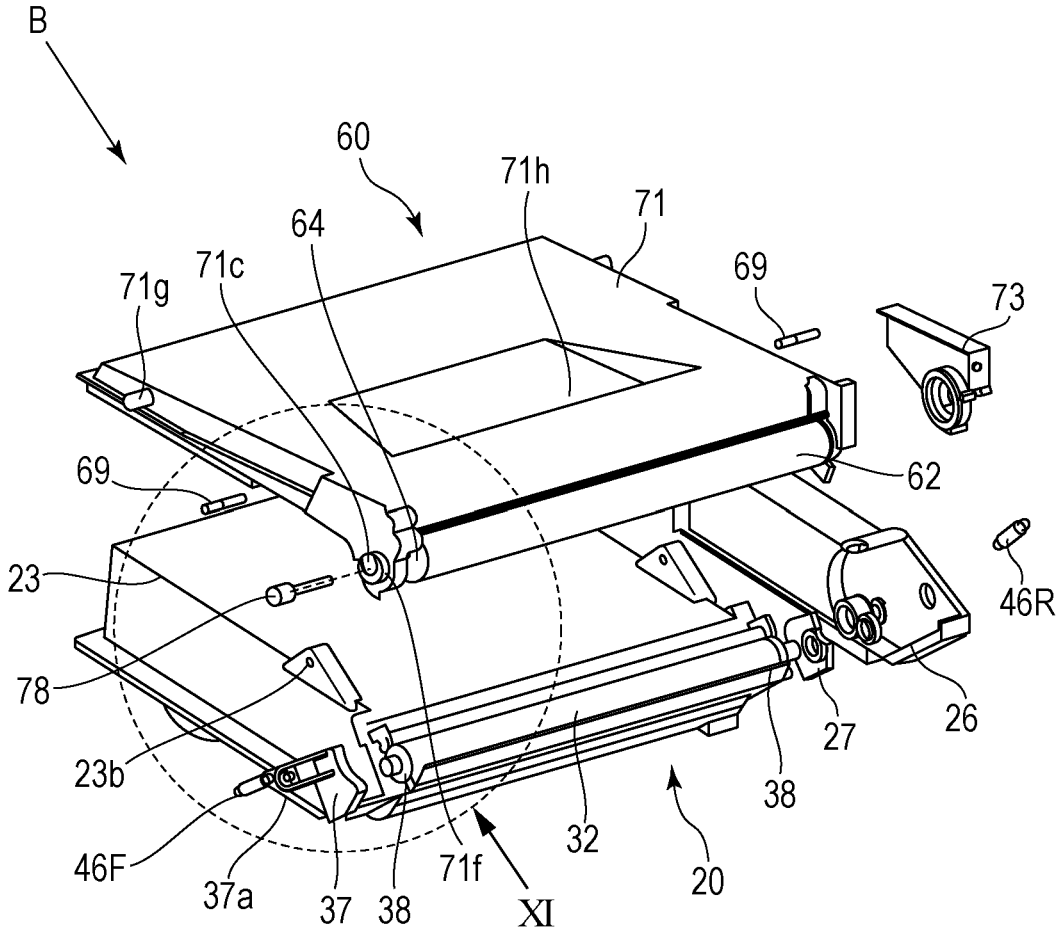
FIG. 10 is an exploded view of the process cartridge.
Figure 11:
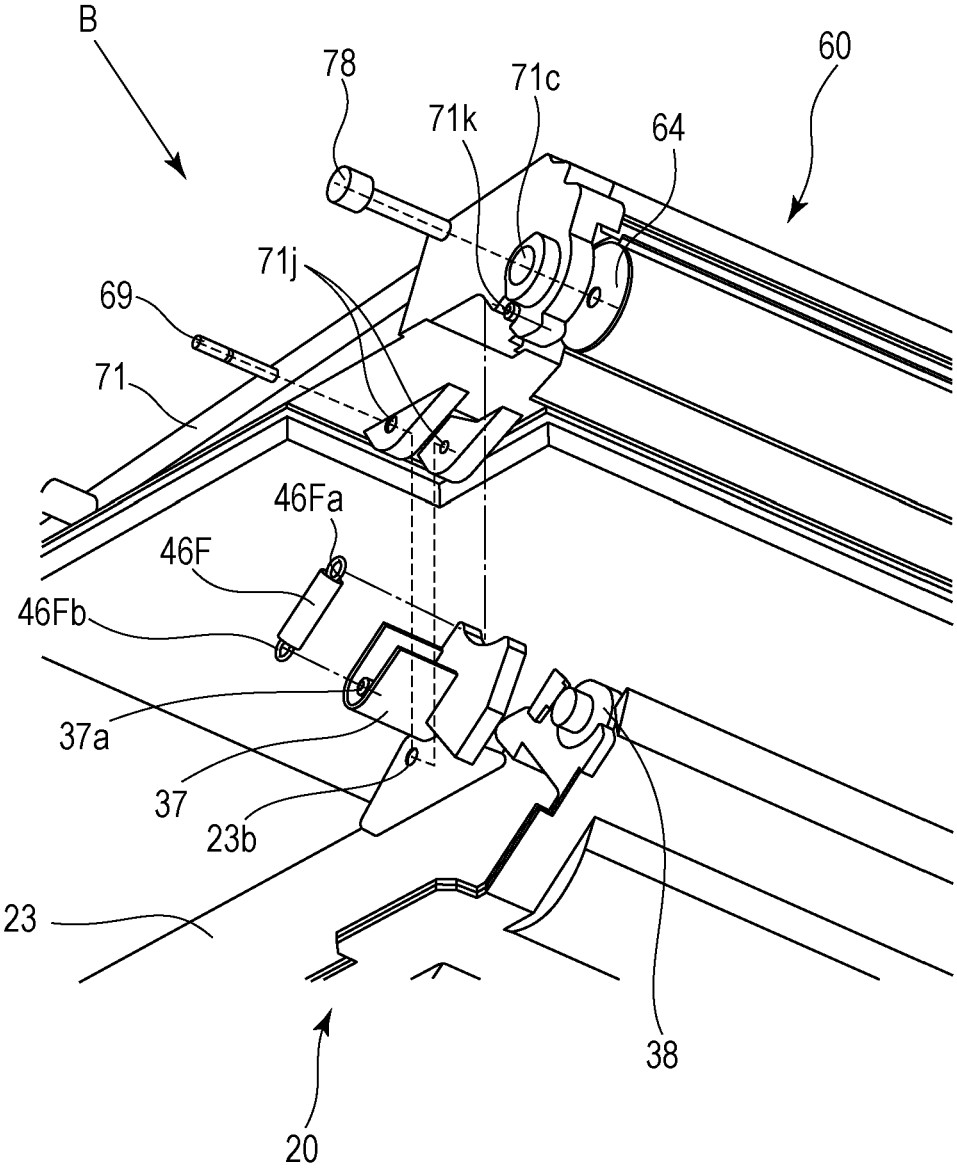
FIG. 11 is an exploded view of the process cartridge.
Figure 12:
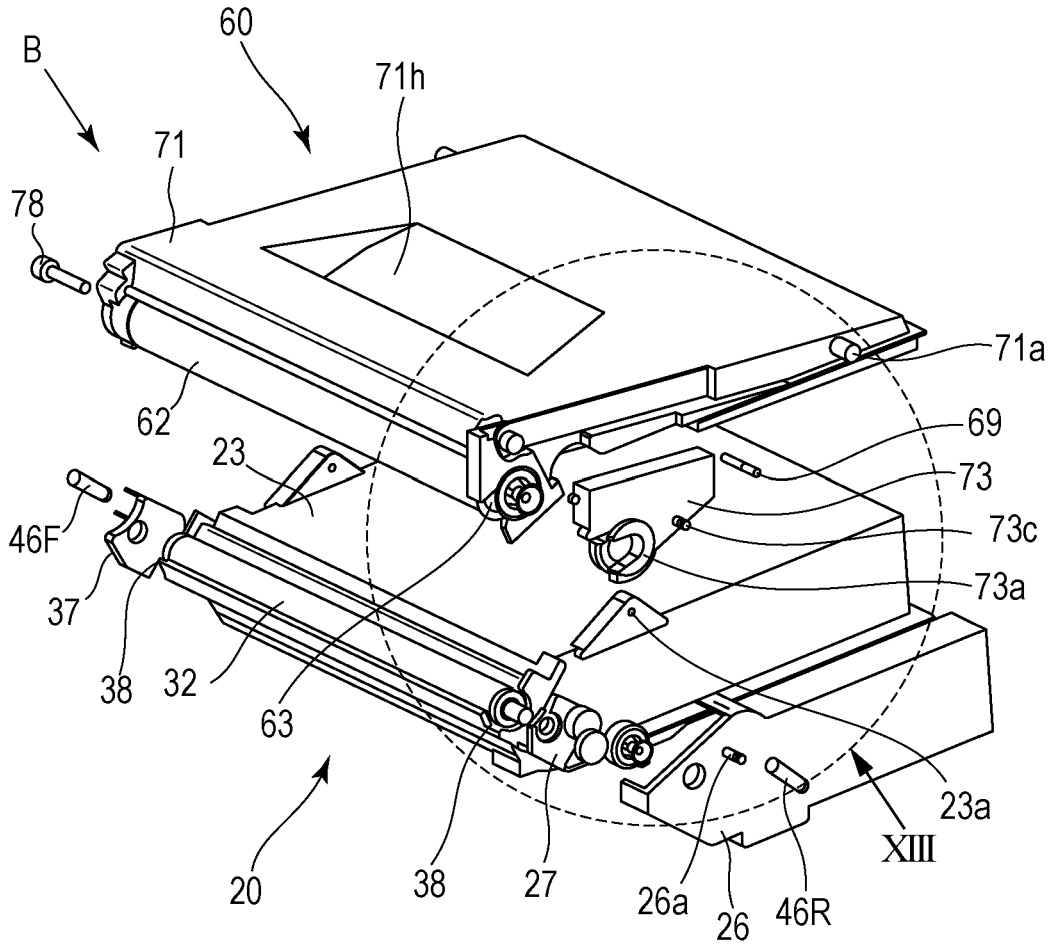
FIG. 12 is an exploded view of the process cartridge.
Figure 13:
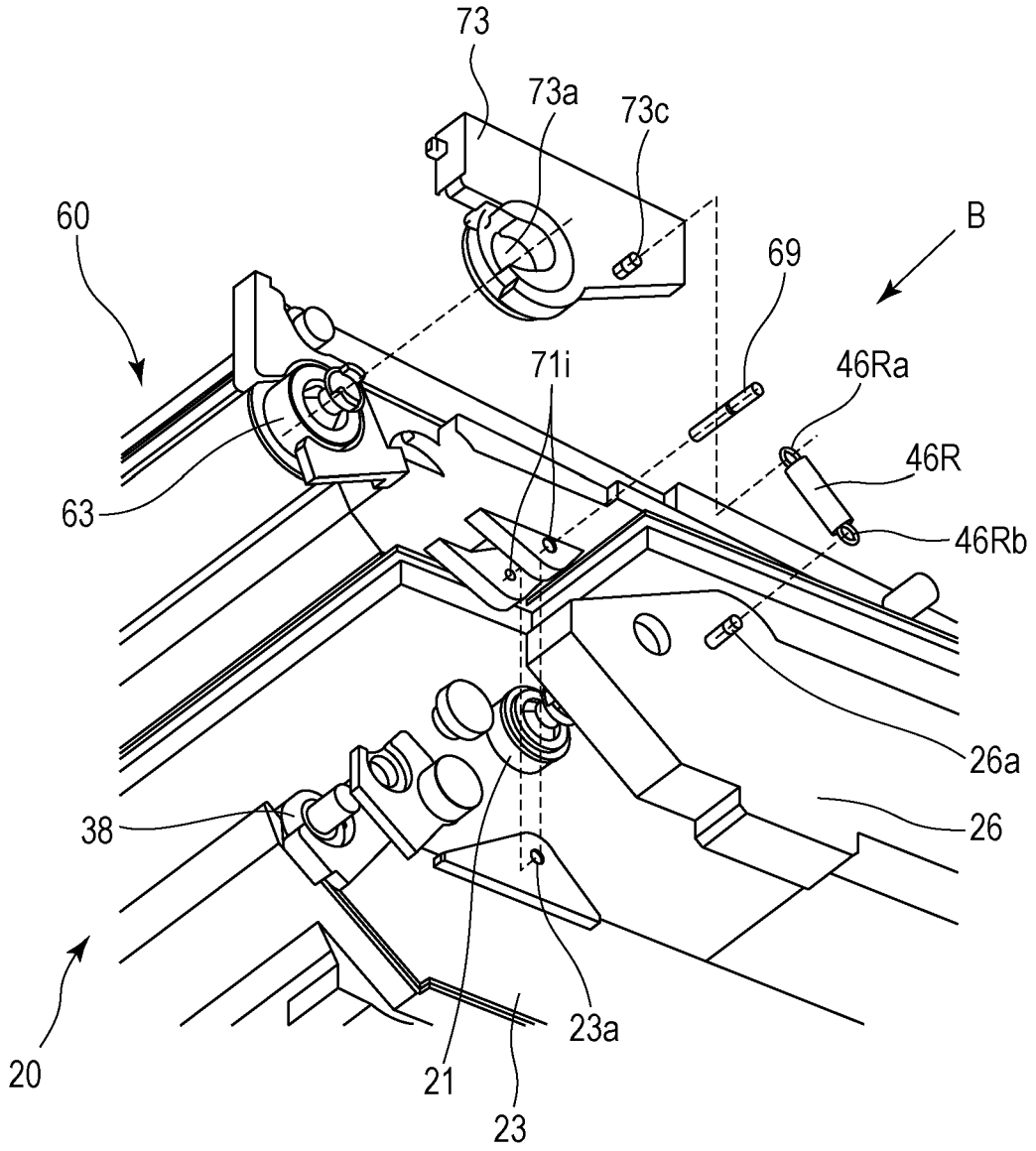
FIG. 13 is an exploded view of the process cartridge.

Next, the entire structure of the cartridge B will be described with reference to FIGS. 3, 4A, 4B, 10, 11, 12, and 13. FIG. 3 is a cross-sectional view of the cartridge B, and FIGS. 10, 11, 12, and 13 are perspective views illustrating the structure of the cartridge B. FIGS. 11 and 13 are partially enlarged views of FIGS. 10 and 12, respectively, corresponding to the portions indicated by the dotted lines with the angles changed. In the present embodiment, screws with which the individual components are joined together are not described.

The cartridge B is a process cartridge which includes the cleaning unit 60 and the developing unit 20. Generally, the process cartridge is an integrated cartridge consisting of the photoconductive drum which is the image carrying member and is the electrophotographic photoconductor, and a process unit which acts on the photoconductive drum. The process cartridge is detachably attached to the apparatus main body of the electrophotographic image forming apparatus. The process unit may be a charging unit, a developing unit, and a cleaning unit.

As illustrated in FIG. 3, the cleaning unit 60 includes the drum 62, the charging roller 66, the cleaning member 77, the cleaning frame 71 which supports these components, and a lid member 72 fixed to the cleaning frame 71 by adhesion, for example. In the cleaning unit 60, the charging roller 66 and the cleaning member 77 are in contact with an outer peripheral surface of the drum 62.

The cleaning member 77 includes a rubber blade 77*a* which is a blade-shaped elastic member formed of rubber as an elastic material, and a support member 77*b* which supports the rubber blade. The rubber blade 77*a* is in contact with the drum 62 in the direction opposite to the rotational direction of the drum 62. That is, the rubber blade 77*a* is in contact with the drum 62 in a manner such that an end portion of the rubber blade 77*a* faces the upstream side of the drum 62 in the rotational direction.

Figure 4A:
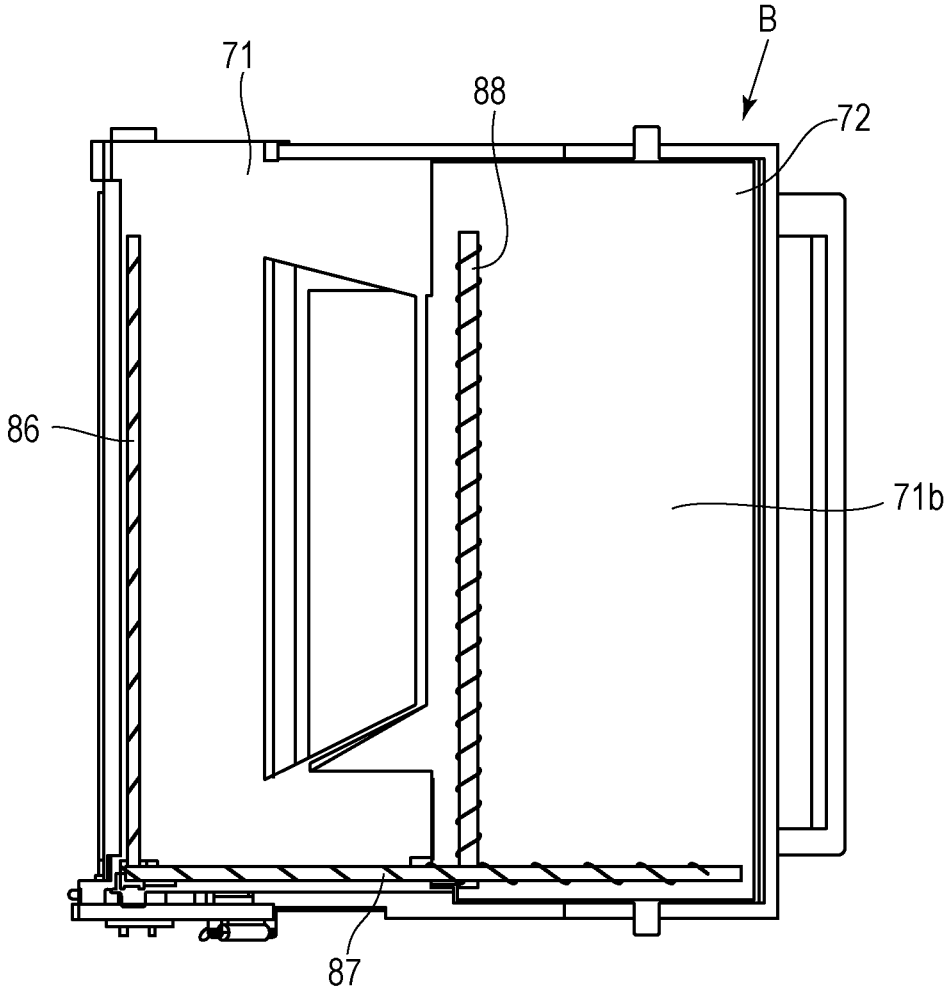
FIG. 4A is a cross-sectional view of the inside of a cleaner case of the process cartridge along line IVA-IVA of FIG. 4B.
Figure 4B:
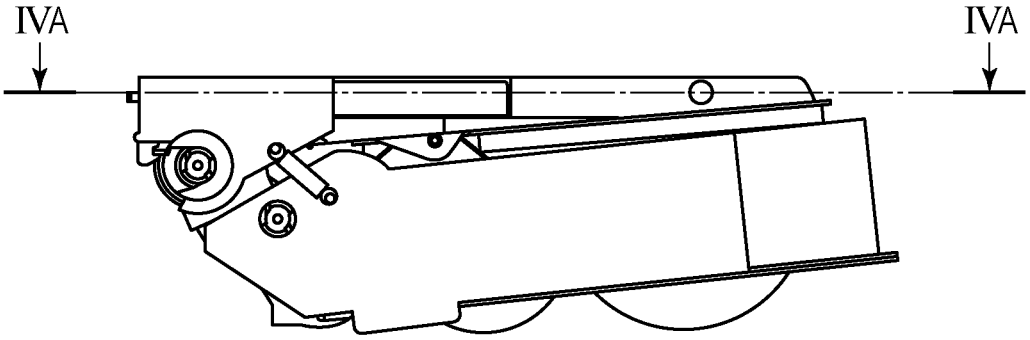
FIG. 4B is a side view of the process cartridge.

FIG. 4A is a cross-sectional view of the cleaning frame 71. As illustrated in FIGS. 3, 4A and 4B, waste toner removed from the surface of the drum 62 by the cleaning member 77 is conveyed by the cleaning member 77 serving as a waste toner conveyance member. The waste toner is conveyed by a first screw 86, a second screw 87, and a third screw 88 serving as waste toner conveyance members, and is accumulated in the waste toner chamber 71*b* which is constituted by the cleaning frame 71 and the lid member 72. The first screw 86 is rotated by driving force from the coupling 21 illustrated in FIG. 13 transmitted via a gear (not illustrated). The second screw 87 is rotated by driving force from the first screw 86, and the third screw 88 is rotated by the driving force of the second screw 87. The first screw 86 is disposed near the drum 62, the second screw 87 is disposed at one longitudinal end of the cleaning frame 71, and the third screw 88 is disposed in the waste toner chamber 71*b*. Rotational axes of the first screw 86 and the third screw 88 are parallel to a rotational axis of the drum 62, and a rotational axis of the second screw 87 orthogonally crosses the rotational axis of the drum 62.

As illustrated in FIG. 3, a scoop sheet 65 which helps prevent leakage of the waste toner from the cleaning frame 71 is provided at an edge of the cleaning frame 71 in such a manner as to be contact with the drum 62.

Upon reception of driving force from a main body driving motor (not illustrated) which is a driving source, the drum 62 is driven to rotate in the direction of arrow R in accordance with an image forming operation.

The charging roller 66 is rotatably attached to the cleaning unit 60 via a charging roller bearing 67 at both longitudinal ends of the cleaning frame 71 (substantially parallel to the direction of the rotational axis of the drum 62). The charging roller 66 is pressed against the drum 62 since the charging roller bearing 67 is pressed toward the drum 62 by the urging member 68. The charging roller 66 is rotated following the rotation of the drum 62.

As illustrated in FIG. 3, the developing unit 20 includes the developing roller 32, a developer container 23 which supports the developing roller 32, and the developing blade 42. A magnet roller 34 is provided in the developing roller 32 which is the developing sleeve. In the developing unit 20, the developing blade 42 for regulating a developer layer on the developing roller 32 is disposed. As illustrated in FIGS. 10 and 12, spacing members 38 are attached at both ends of the developing roller 32. Since the spacing members 38 and the drum 62 are in contact with each other, the developing roller 32 is held with a slight space from the drum 62. As illustrated in FIG. 3, a leakage prevention sheet 33 which helps prevent leakage of toner from the developing unit 20 is provided at an edge of a bottom member 22 in such a manner as to be in contact with the developing roller 32. The first conveyance member 43, the second conveyance member 44, and the third conveyance member 50 are provided in the toner chamber 29 constituted by the developer container 23 and the bottom member 22. The first conveyance member 43, the second conveyance member 44, and the third conveyance member 50 stir the toner contained in the toner chamber 29, and convey the toner to the toner supply chamber 28.

As illustrated in FIGS. 10 and 12, the cartridge B is integrally constituted by the cleaning unit 60 and the developing unit 20.

The cleaning unit 60 includes the cleaning frame 71, the lid member 72, the drum 62, and the drum bearing 73 which rotatably supports the drum 62, and a drum shaft 78. On the driving side, as illustrated in FIG. 13, a driving side drum flange 63 of the drum provided on the driving side is rotatably supported by a hole 73*a* of the drum bearing 73. On the non-driving side, as illustrated in FIG. 11, the drum shaft 78 press-fitted into a hole 71*c* provided in the cleaning frame 71 rotatably supports a hole of a non-driving side drum flange 64 (not illustrated).

As illustrated in FIGS. 3, 10, and 12, the developing unit 20 includes the bottom member 22, the developer container 23, a driving side development side member 26, the developing blade 42, and the developing roller 32. The developing roller 32 is rotatably attached to the developer container 23 with bearing members 27 and 37 provided at both ends thereof.

As illustrated in FIGS. 11 and 13, the cleaning unit 60 and the developing unit 20 are connected to each other with a connection pin 69 so as to be pivotable with respect to each other, thus forming the cartridge B.

Specifically, at both longitudinal ends of the developing unit 20, a development first support hole 23*a* and a development second support hole 23*b* are provided in the developer container 23. At both longitudinal ends of the cleaning unit 60, first hanging holes 71*i* and second hanging holes 71*j* are provided in the cleaning frame 71. When the connection pin 69 press-fitted into and fixed to the first hanging holes 71*i* is fitted into the development first support hole 23*a*, and when the connection pin 69 press-fitted into and fixed to the second hanging holes 71*j* is fitted into the development second support hole 23*b*, the cleaning unit 60 and the developing unit 20 are connected to each other so as to be pivotable with respect to each other.

A first hole 46Ra of a driving side urging member 46R is hung on a boss 73*c* of the drum bearing 73, and a second hole 46Rb of the driving side urging member 46R is hung on a boss 26*a* of the driving side development side member 26.

A first hole 46Fa of a non-driving side urging member 46F is hung on a boss 71*k* of the cleaning frame 71, and a second hole 46Fb of the non-driving side urging member 46F is hung on a boss 37*a* of the bearing member 37.

In the present embodiment, the driving side urging member 46R and the non-driving side urging member 46F are formed by tension springs. With the urging force of the tension spring, the developing unit 20 is urged against the cleaning unit 60, and the developing roller 32 is reliably pressed toward the drum 62. The developing roller 32 is held with a predetermined space from the drum 62 by the spacing members 38 attached at both ends of the developing roller 32.

Developer Amount Detecting Unit

Developer amount detection will be described with reference to FIGS. 14 and 15.

Figure 14:
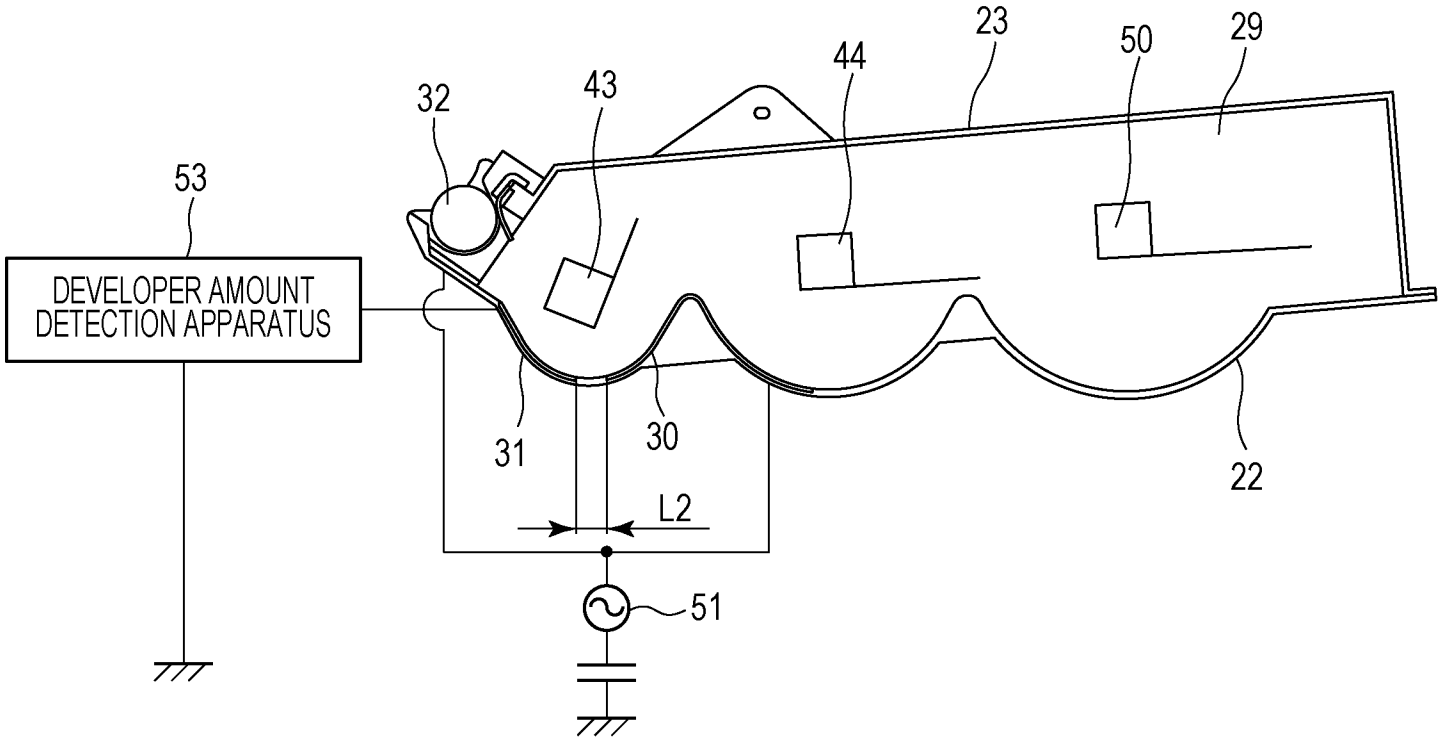
FIG. 14 is a cross-sectional view of a developing apparatus illustrating a developer amount detecting unit according to the first embodiment.

FIG. 14 is a cross-sectional view of the developing apparatus illustrating a developer amount detecting unit.

As illustrated in FIG. 14, as a detecting unit for detecting a toner amount which is a developer amount, a first electrode 30 which is a first electrode and a second electrode 31 which is a second electrode are provided on a bottom surface of the toner chamber 29 inside of the toner chamber 29.

When a voltage in which an AC voltage and a DC voltage are superimposed is applied to the developing roller 32 from a development bias power supply 51, a current corresponding to the electrostatic capacitance between the developing roller 32 and the second electrode 31 is induced between the developing roller 32 and the second electrode 31.

When a voltage in which an AC voltage and a DC voltage are superimposed is applied to the first electrode 30 from the development bias power supply 51, a current corresponding to the electrostatic capacitance between the first electrode 30 and the second electrode 31 is induced between the first electrode 30 and the second electrode 31. Here, electrostatic capacitance between the developing roller 32 and the second electrode 31 changes depending on the toner amount between the developing roller 32 and the second electrode 31, and electrostatic capacitance between the first electrode 30 and the second electrode 31 changes depending on the toner amount between the first electrode 30 and the second electrode 31.

A change in the value of a current flowing in the second electrode 31 is measured by a developer amount detection apparatus in the apparatus main body A via a contact point provided in the cartridge B and a main body contact point of the apparatus main body.

The first electrode 30 and the second electrode 31 are disposed below the first conveyance member 43 along the bottom surface of the toner chamber 29 with a distance L2 therebetween. The distance L2 is located at the lowermost portion of the toner chamber 29. The shaft 43*a* of the first conveyance member is disposed immediately above the distance L2.

The first conveyance member 43 is constituted by the shaft 43*a* and the conveying portion 43*b* of the flexible sheet shaped member. The shaft 43*a* is rotatably supported, and the conveying portion 43*b* conveys toner on the bottom surface of the toner chamber 29 through rotational driving of the shaft 43*a*. Therefore, the conveyed toner passes through the distance L2 on the bottom surface of the toner chamber 29.

Since the distance L2 between the first electrode 30 and the second electrode 31 is provided at the position described above, even when the amount of toner in the toner chamber 29 becomes small, the toner amount can be measured accurately.

Figure 15:
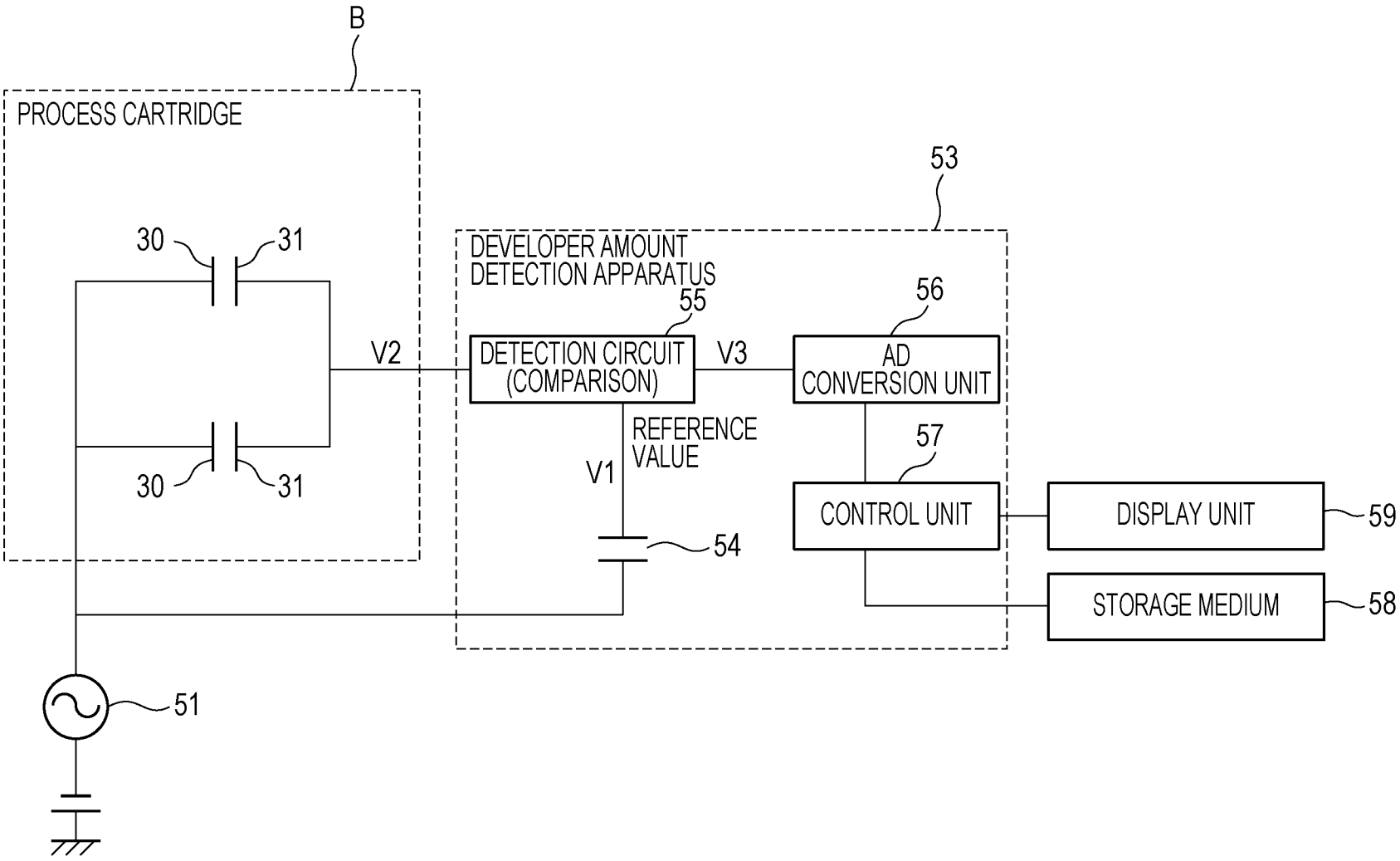
FIG. 15 is a circuit configuration diagram of a developer amount detection apparatus according to the first embodiment.

FIG. 15 is a circuit configuration diagram of the developer amount detection apparatus. In the present embodiment, when a voltage in which an AC voltage and a DC voltage are superimposed is output from a development bias application unit 51, the voltage is applied to each of a reference capacitor 54, the developing sleeve 32, and the first electrode 30.

Therefore, a voltage V1 is generated in the reference capacitor 54 and a voltage V2 is generated in the first electrode 30 in accordance with the current according to composite electrostatic capacitance.

A detection circuit 55 generates a voltage V3 from a voltage difference between the voltage V1 and the voltage V2 and outputs the voltage V3 to an AD conversion unit 56.

The AD conversion unit 56 outputs a result of digital conversion of the analog voltage V3 to a control unit 57. The control unit 57 determines a level of residual toner which is a developer amount from this result, stores the result in a storage medium 58, and displays the residual toner level on a display unit 59.

Manufacturing Method of Developer Container

Manufacture of the developer container will be described with reference to FIGS. 16, 17A and 17B.

Figure 16:
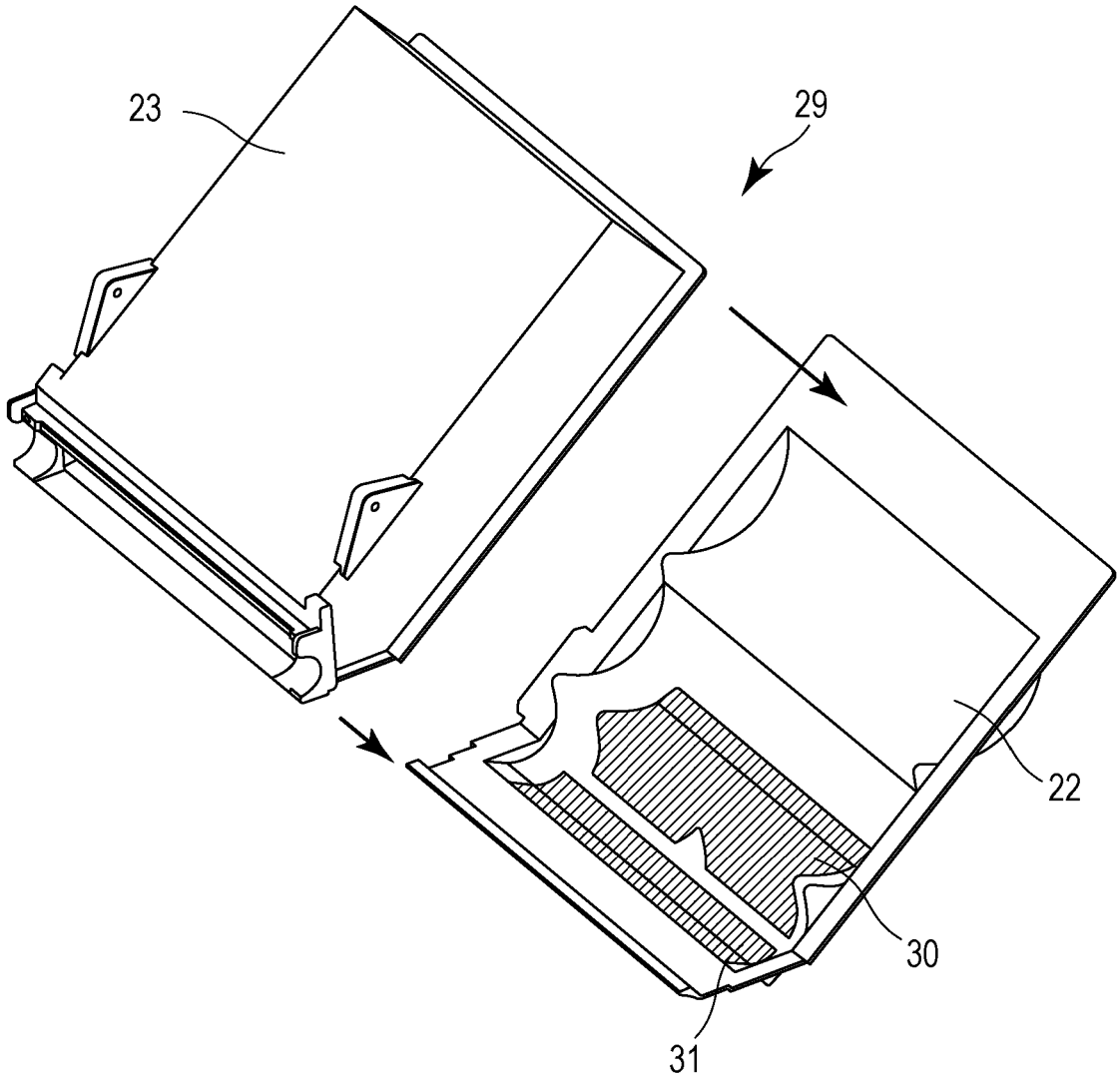
FIG. 16 is a perspective view illustrating a manufacturing method for the developer container according to the first embodiment.

FIG. 16 is a perspective view of the developer container illustrating a manufacturing method for the developer container.

Figure 17A:
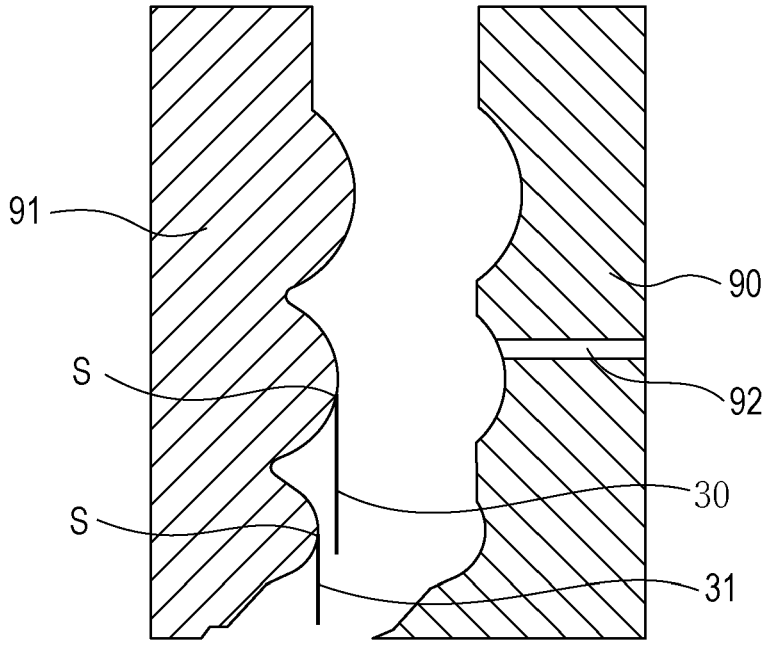
FIGS. 17A and 17B are cross-sectional views of a mold illustrating a manufacturing method for the bottom member which is a part of the developer container according to the first embodiment.
Figure 17B:
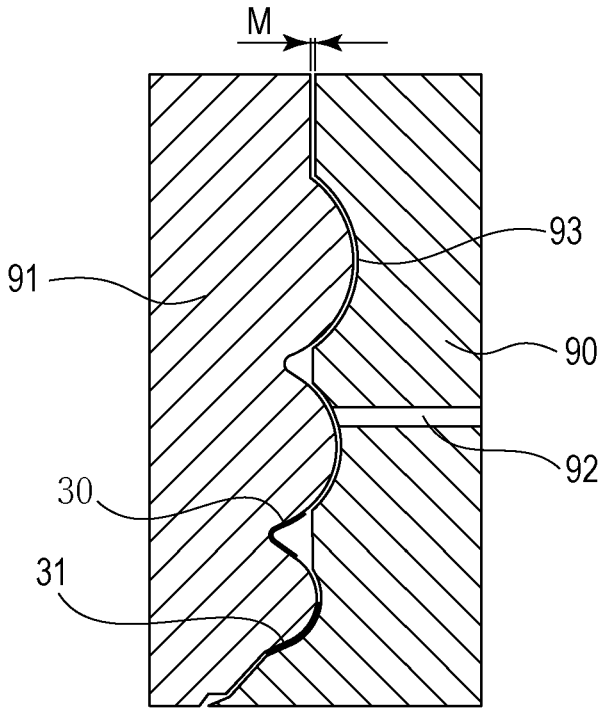

FIGS. 17A and 17B are cross-sectional views of a mold illustrating a manufacturing method for the developer container.

As illustrated in FIG. 16, a developer container 29 in the present embodiment is constituted by the bottom member 22 which is a first frame and the developer container 23 which is a second frame.

In the present embodiment, the first electrode 30 and the second electrode 31 are formed integrally with the bottom member 22.

Although described later, the first electrode 30 and the second electrode 31 are formed by conductive resin sheets.

FIG. 17A illustrates a state in which the mold is open, and FIG. 17B illustrates a state in which the mold is closed.

The mold is constituted by a first mold 90 and a second mold 91, each of which has a shape which will become a surface shape of the bottom member 22 when transferred.

The first mold 90 has an inlet (a gate) 92 through which resin is poured into a hollow (a cavity) 93 inside of the mold.

First, when the mold of FIG. 17A is opened, conductive resin sheets which will become the first electrode 30 and the second electrode 31 are inserted into the mold at positions that face each other.

Very small air holes are formed in the mold at positions denoted by "S" to suction the first electrode 30 and the second electrode 31, and the air holes are connected to a suction unit, which is not illustrated. Then, the first electrode 30 and the second electrode 31 are held by (or fixed to) the second mold 91 (a holding process) by suctioning.

The first electrode 30 and the second electrode 31 are held by (or fixed to) the second mold 91 in the present embodiment, however, these electrodes do not necessarily have to be held by (or fixed to) the second mold, and may be held by (or fixed to) the first mold 90. Alternatively, these electrodes may be held (or fixed) by other known methods.

Next, as illustrated in FIG. 17B, the first mold 90 and the second mold 91 are fitted together (mold closure).

Molten resin is poured into the hollow (the cavity) 93 through a gate 92 formed when the molds are fitted together. Then, the bottom member 22 is molded.

When the resin is poured into the hollow (the cavity) 93, the bottom member 22 is shaped and, at the same time, the first electrode 30 and the second electrode 31 adhere to the molded bottom member 22, and an integrated molded article is thus formed.

Resin is poured in from a plurality of inlets. Therefore, a confluence in which a flow of resin poured from a first inlet and a flow of resin poured from a second inlet which is different from the first inlet merge with each other is formed within the hollow (the cavity) 93. If the resin is further poured in after the confluence is formed, the confluence will expand. The expanded confluence is also referred to as a weld line W. The confluence melts or pulls on a part of the electrode which is resin, and forms an extension of the electrode.

When the first mold 90 and the second mold 91 are fitted together, since the first mold 90 and the second mold 91 face each other at a distance M, the distance M is defined as a thickness M of the bottom member 22.

Although two resin sheets for the first electrode 30 and the second electrode 31 are inserted into the mold in the description above, any numbers of resin sheets may be inserted as necessary in the same manner.

The developer container is formed by welding together the bottom member which is the molded second frame to which the first electrode 30 and the second electrode 31 are adhered, and the developer container which is the first frame by ultrasonic welding.

In this specification, the process until molding the bottom member which is the second frame, and welding the developer container which is the first frame and the bottom member which is the second frame together to form the developer container is referred to as a forming step.

Electrodes Serving as Developer Amount Detecting Units

The first electrode 30 and the second electrode 31 are formed by conductive resin sheets.

In the present embodiment, 0.1 mm-thick resin sheets are used. In the present embodiment, "a material having conductivity" refers to a material having surface resistivity of 10 kΩ/sq or below, and "a material having no conductivity" refers to a material having surface resistivity greater than 10 kΩ/sq when measured by a method prescribed by JIS K 7194.

As a material of conductive resin sheets, ethylene-vinyl acetate copolymer (EVA)-based resin in which carbon black is dispersed is used.

In the present embodiment, by bonding EVA-based resin to PS-based resin with heat and pressure during molding of the bottom member 22 by the molding process described above, the first electrode 30, the second electrode 31, and the bottom member 22 which are the conductive resin sheets are formed integrally.

However, the configuration is not restricted to this example, and resin sheets of other thicknesses or other combinations of resin materials may also be employed.

More specifically, in the present embodiment, a 0.1 mm-thick resin sheet is selected from the viewpoint of the influence on the deformation of the frame, transferability to the frame shape, and conductivity, however, the thickness of the resin sheet may be suitably changed. An EVA-based resin having adhesiveness with the material of the bottom member 22 is selected as the material of the resin sheets, however, a resin which melts with the resin of the bottom member 22 and having compatibility with the resin of the bottom member 22 so as to be capable of integrating therewith with no interface may be used as the material of the resin sheets.

In the present embodiment, a thermal deformation temperature (a glass transition temperature) of the resin used for the bottom member 22 is about 90° C., and the thermal deformation temperature of ethylene-vinyl acetate copolymer (EVA)-based resin used for a developer amount detection member which is a conductive resin sheet is about 80° C.

The thermal deformation temperatures of the bottom member 22, the first electrode 30, and the second electrode 31 are illustrative only and not restrictive.

The thermal deformation temperature of the resin which forms the conductive sheet member may be lower than the thermal deformation temperature of the resin which forms the frame.

Bottom Member Which is Part of Developer Container

The bottom member 22 will be described with reference to FIG. 1.

Figure 1:
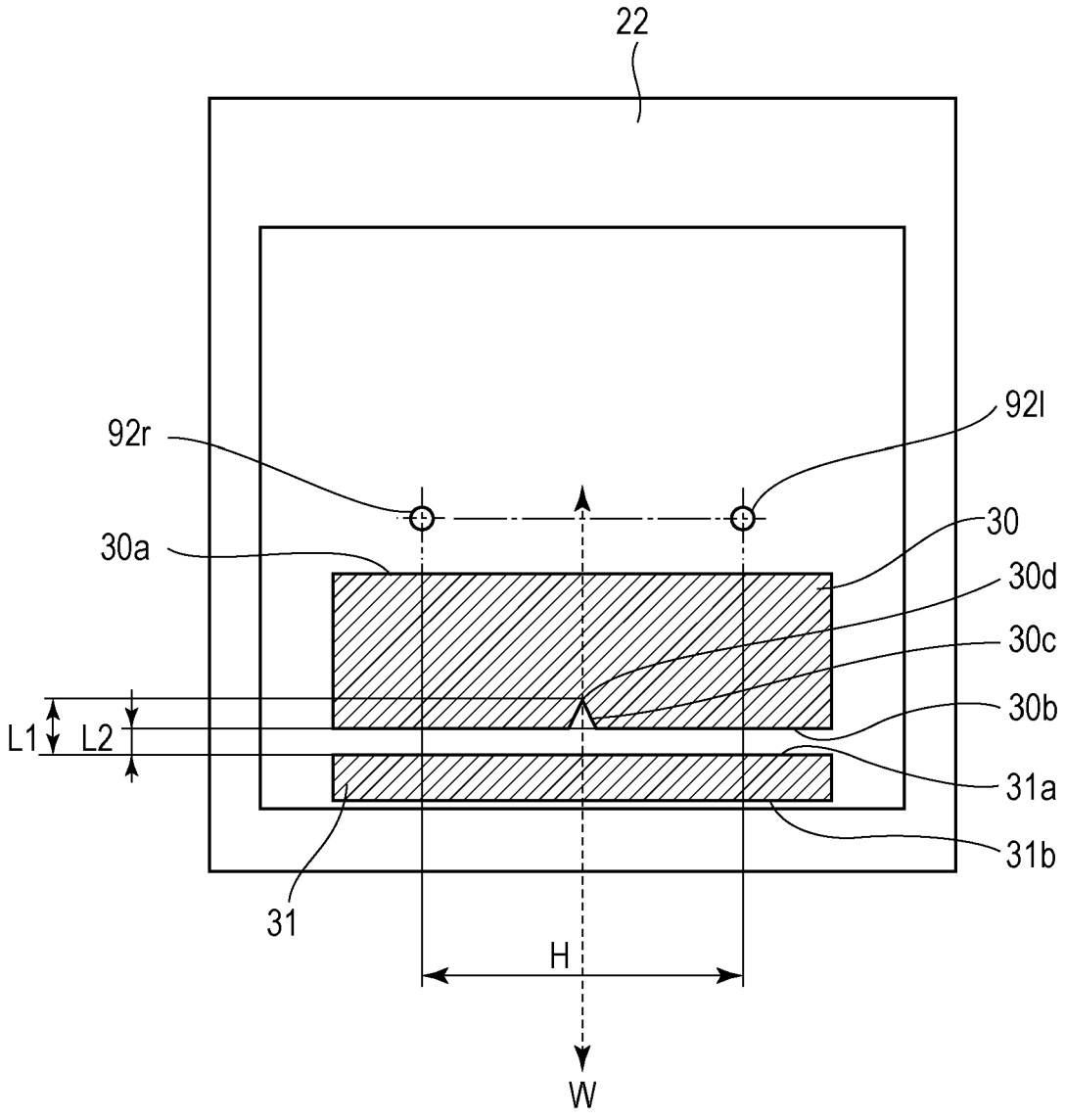
FIG. 1 is a schematic view illustrating a bottom member which is a part of a developer container according to a first embodiment.

FIG. 1 illustrates the inside of the bottom member 22 as a front view taken in the direction toward the gate 92.

A plurality of gates may be provided since the number of the gates 92 may change depending on the size of the frame to be formed. In the present embodiment, a two-point gate is employed. A first gate is defined as a gate 92*r* and a second gate is defined as a gate 92*l* of the gate 92 of the bottom member 22.

The resin in the hollow 93 during molding described above flows toward an end of the shape to be molded from the first gate 92*r* and the second gate 92*l*. Therefore, the first gate 92*r* and the second gate 92*l* are defined as the most upstream points, and the end portion of the shape (the bottom member) to be molded is defined as being downstream. In FIG. 1, the gates are located upstream and one end portion of the bottom member is located downstream in the downward direction.

The shape of the bottom member 22 is formed during molding when the resin poured in from the gates 92*r* and 92*l* flows to the downstream side from the upstream side.

The first electrode 30 will be described with reference to FIG. 1. The first electrode 30 is disposed upstream of the second electrode 31. In the present embodiment, the first electrode 30 has a recess at a position which faces an upstream end of the second electrode.

When seen from an axial direction of the developing roller as illustrated in FIG. 14, the first electrode 30 is disposed at the most lower portion of the toner chamber 29 along the bottom surface of the toner chamber 29. Similarly, the second electrode 31 is disposed along the bottom surface of the toner chamber 29. Regarding the distance between the first electrode 30 and the second electrode 31 in the present embodiment (FIG. 14), the distance between a downstream end 30*b* of the first electrode 30 and an upstream end 31*a* of the second electrode 31 is defined as a distance L. The distance between a downstream end 30*b* which is one longitudinal end of the first electrode 30 and the upstream end 31*a* of the second electrode 31 (for example, one longitudinal end of the second electrode 31 at the corresponding position) is defined as a distance L2. A notch 30*c* of a first electrode is in a part of the downstream end 30*b* of the first electrode 30 before the molding process. The notch 30*c* which is a recess is provided at the longitudinal center of the first electrode 30 in the present embodiment. In the present embodiment, a bottom portion 30*d* of the recess is provided at the longitudinal center of the first electrode 30. The distance from the bottom portion 30*d* of the recess to the upstream end 31*a* of the longitudinal center of the second electrode located at the corresponding position is set to the distance L1. However, the distance L1 is not limited to this, and the distance from a position near the bottom portion in the recess to the upstream end 31*a* of the longitudinal center of the second electrode located at the corresponding position may be set to the distance L1. This is because the distance may change due to a projection formed from the bottom portion in some manufacturing processes.

In the present embodiment, a relationship between the distance L2 and the distance L1 is L2<L1.

Figure 20:
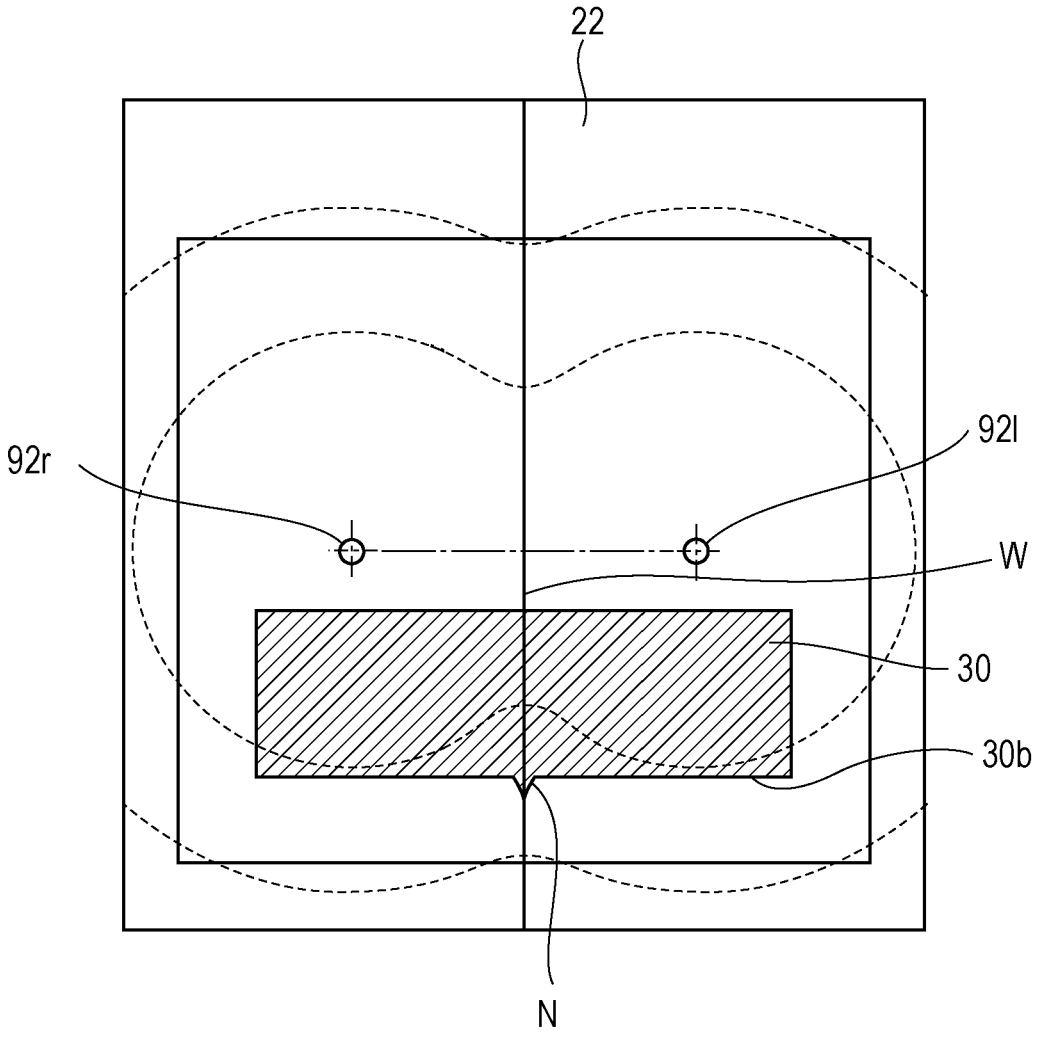
FIG. 20 is a schematic view illustrating a flow of resin inside of the mold illustrating a manufacturing method for the bottom member which is a part of the developer container.

An area in which the distance between the first electrode 30 and the second electrode 31 will become L1 with the existence of the notch 30*c* is located in an area H between the first gate 92*r* and the second gate 92*l*. In particular, the area in which the distance between the first electrode 30 and the second electrode 31 will become L1 is located in the confluence in which the resin poured in from the first gate 92*r* and the resin poured from the second gate 92*l* merge with each other in the hollow (the cavity) 93 within the mold, and an area corresponding to a thin line (a weld line) produced at a portion in which the resin merge with each and melt together. That is, the confluence is formed by the poured resin. When resin is further poured after the confluence is formed, the weld line W is formed in the vertical direction of FIG. 1 so as to include the confluence. The weld line W is a portion in which the confluence is first formed as a point and then expands in the vertical directions, which is referred to as a confluence in the specification. In FIG. 1, the conductive sheets located in an area overlapping the weld line W which is the confluence are pulled by the flow of resin, and the projection N as illustrated in FIG. 20 is produced. In the present embodiment, however, the distance between the conductive sheets disposed in the area on the confluence is set to be longer than the distance of other areas (for example, the distance between longitudinal ends) in consideration of the projection N. Therefore, even if the projection N is produced, contact between the conductive sheets which are electrodes due to the projection N is avoided.

Figure 19A:
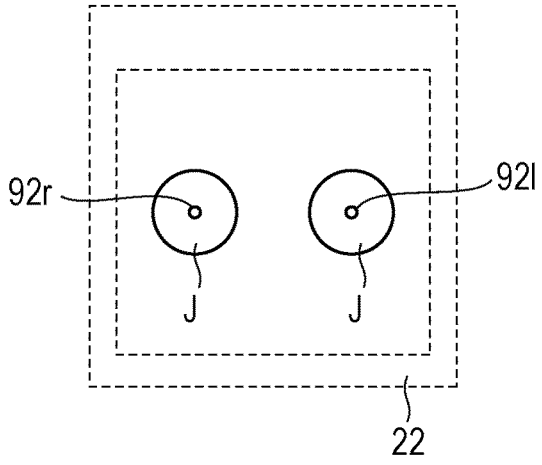
FIGS. 19A to 19C are schematic views illustrating a flow of resin inside of a mold illustrating a manufacturing method for the bottom member which is a part of the developer container.
Figure 19B:
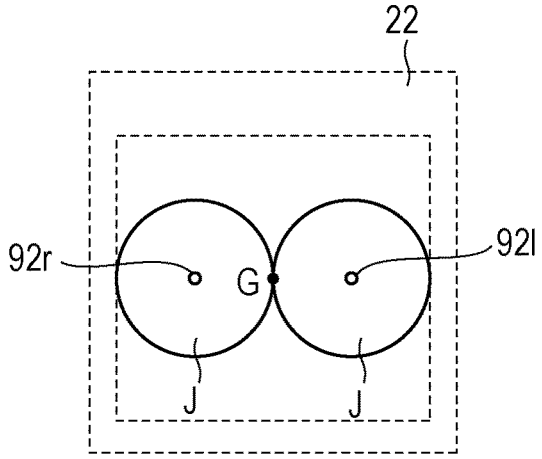
Figure 19C:
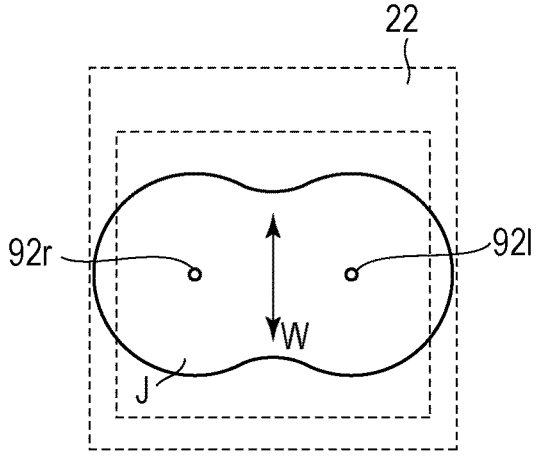

Regarding the first electrode 30, the distance L1 between the downstream end 30*d* of the notch of the first electrode 30 and the upstream end of the second electrode 31 is provided. This is in order that even if the projection N is produced in an area corresponding to the weld line W of the first electrode 30 illustrated in FIG. 19C described above, a situation in which the projection N approaches or contacts the second electrode 31 is avoided. Since the first electrode 30 is notched, the distance L1 between the downstream end 30*d* of the first electrode 30 and the upstream end of the second electrode 31 is provided.

The recess of the first electrode is located at an intermediate point between the gate 92*r* and the gate 92*l*. Therefore, the lower end portion 30*d* of the recess of the first electrode of the present embodiment is provided at the same distance from the gate 92*r* and the gate 92*l*. In a manufactured developer container or the like, an inlet vestige is formed by resin when the resin is poured from the gate which is the inlet. Therefore, the distance between the inlet vestige and the electrode, the distance between the inlet vestige and the bottom portion of the recess, etc. can be determined also from the molded article.

Unless otherwise specified, functions, materials, shapes, relative arrangements thereof, and so forth of the components described in the present embodiment are illustrative only and not restrictive.

Second Embodiment

Next, a second embodiment of the present disclosure will be described with reference to the drawings.

In the present embodiment, differences from the first embodiment will be described in detail. Unless otherwise specified, materials, shapes, etc. are the same as those of the first embodiment. The same components are denoted by the same reference numerals and not described in detail.

A bottom member 22 which is a part of a developer container will be described with reference to FIG. 18.

Figure 18:
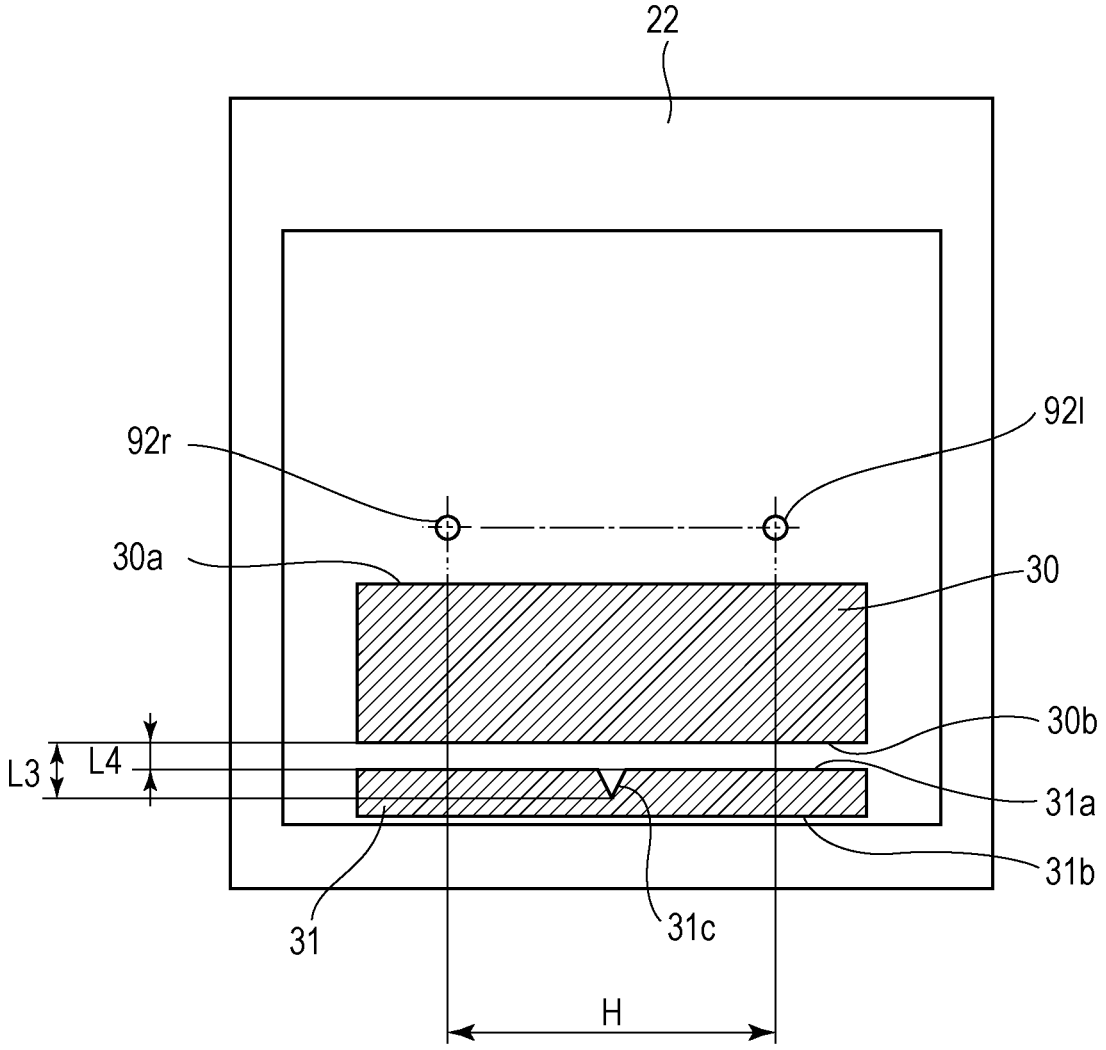
FIG. 18 is a schematic view illustrating a bottom member which is a part of a developer container according to a second embodiment.

FIG. 18 illustrates the inside of the bottom member 22 as a front view in the direction of a gate 92.

A first electrode 30 will be described with reference to FIG. 18. The first electrode 30 is disposed upstream of a second electrode 31.

A distance between the first electrode 30 located at the most lower portion of a toner chamber 29 along a bottom surface of the toner chamber 29 described above and the second electrode 31 (FIG. 14) is formed by a distance between a downstream end 30*b* of the first electrode 30 and an upstream end 31*a* of the second electrode 31.

The distance between the downstream end 30*b* of the first electrode 30 and the upstream end 31*a* of the second electrode 31 is L4. Since a notch 31*c* of a recessed shape is formed at a part of the upstream end 31*a* of the second electrode 31, the distance L4 will become a distance L3 in this portion. In the present embodiment, the distance to the corresponding center of the first electrode 30 in the longitudinal direction (the longitudinal center) from the notch which is the recess of the second electrode 31 is the distance L3.

The relationship between the distance L4 and the distance L3 is L4<L3.

As described above, the same effects as those of the first embodiment described above can be obtained by providing the notch 31*c* in the second electrode 30.

The notch 31*c* which is a recess does not necessarily be disposed at the longitudinal center, but may be disposed in an area on a confluence produced by pouring of resin. For example, the recess may be provided at one longitudinal end of the electrode.

Third Embodiment

Various alternative embodiments will be described.

Although the recess is triangular in shape in the first and the second embodiments, the shape of the recess is not limited to the same. The recess may be quadrangular, rectangular, trapezoidal, and semicircular in shape. The structure of the cartridge is not limited to the process cartridge structure described in the first and the second embodiments. For example, there are a developer container which contains developer (e.g., a toner cartridge), and a developing apparatus which at least includes a developer carrying member (e.g., a developing cartridge).

Here, in the developing apparatus, the developing apparatus itself has a frame containing the developer, and when the contained developer is used up, the developing apparatus itself is replaced. Alternatively, the developing apparatus may have a developer container containing developer which is detachably attached to the developing apparatus. In this case, in the developing apparatus, the developer can be replenished from the developer container to a space which can contain the developer of the frame which supports the developer carrying member.

Only the process cartridge may be detachably attached to the apparatus main body of the image forming apparatus, or both the developing cartridge and the drum cartridge may be detachably attached to apparatus main body of the image forming apparatus. If two cartridges are to be attached, after attaching the developing cartridge to the drum cartridge, these cartridges may be attached to the apparatus main body of the image forming apparatus. Alternatively, these cartridges may be attached separately to the apparatus main body regardless of the attachment state of other cartridge.

Although a structure to which a single cartridge is detachably attached is described, a plurality of cartridges may also be detachably attached. For example, if the apparatus is a color image forming apparatus, the same four types of yellow, magenta, cyan, and black (YMCK) cartridges may be detachably attached.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-226554 filed Nov. 22, 2016, and No. 2017-199623 filed Oct. 13, 2017, which are hereby incorporated by reference herein in their entirety.

What is claimed is:

1. A manufacturing method for a developer container capable of detecting a developer amount using a change in electrostatic capacitance between a first electrode and a second electrode, comprising:

holding a first resin sheet, which will become the first electrode, to a first area of a mold and a second resin sheet, which will become the second electrode, to a second area of the mold, the second resin sheet including a recess in such that the recess is located at a position that faces a longitudinal end portion of the first resin sheet; and molding the developer container which includes the first resin sheet and the second resin sheet by pouring resin in from a first inlet of the mold and a second inlet of the mold, wherein the recess is disposed in an area in which a confluence is formed by the merging of the resin poured from the first inlet and the resin poured from the second inlet.

2. The manufacturing method for the developer container according to claim 1, wherein a distance from the longitudinal end portion of the first resin sheet to a longitudinal end portion of the second resin sheet is shorter than a distance from a bottom portion of the recess of the second resin sheet to the first resin sheet.

3. The manufacturing method for the developer container according to claim 1, wherein the forming includes pouring resin in from the first inlet and the second inlet, forming a first frame including the first resin sheet and the second resin sheet, and welding the first frame and a second frame which is different from the first frame to form the developer container.

4. The manufacturing method for the developer container according to claim 1, wherein a glass transition temperature of resin which constitutes the first resin sheet is lower than a glass transition temperature of the resin poured into the first and second inlets.

5. The manufacturing method for the developer container according to claim 1, wherein the shape of the recess is any one of triangular, quadrangular, trapezoidal, rectangular, and semicircular shapes.

6. The manufacturing method for the developer container according to claim 1, wherein the developer container includes a conveyance member which has a sheet-shaped conveyance unit for conveying the developer and, wherein in a rotational direction of the conveyance member, the second resin sheet is located on the upstream side of the first inlet and the second inlet, and is located on the downstream side of the first resin sheet.

* * * * *